US008347446B2

(12) United States Patent
Harr

(10) Patent No.: US 8,347,446 B2
(45) Date of Patent: Jan. 8, 2013

(54) DRAINAGE STRUCTURE CLEANING TOOL

(75) Inventor: Robert E. Harr, Pritchett, CO (US)

(73) Assignee: Harr Technologies, Inc, Anchorage, AK (US)

( * ) Notice: Subject to any disclaimer, the term of this patent is extended or adjusted under 35 U.S.C. 154(b) by 0 days.

(21) Appl. No.: 11/981,723

(22) Filed: Oct. 31, 2007

(65) Prior Publication Data

US 2008/0127438 A1 Jun. 5, 2008

Related U.S. Application Data

(63) Continuation of application No. 11/906,922, filed on Oct. 4, 2007, now Pat. No. 7,721,375, which is a continuation of application No. 11/375,886, filed on Mar. 15, 2006, now abandoned, which is a continuation-in-part of application No. 10/857,411, filed on May 27, 2004, now abandoned.

(60) Provisional application No. 60/476,568, filed on Jun. 6, 2003, provisional application No. 60/476,937, filed on Jun. 9, 2003, provisional application No. 60/492,422, filed on Aug. 4, 2003.

(51) Int. Cl.
*B08B 1/04* (2006.01)
*B08B 9/04* (2006.01)

(52) U.S. Cl. ..... 15/104.31; 15/104.095; 15/104.16; 166/170; 166/173; 175/62; 175/203

(58) Field of Classification Search ..... 15/104.31, 15/104.095, 104.13, 104.09, 104.15, 104.16, 15/104.12; 175/19, 220, 203, 62, 406, 65, 175/69; 166/170, 173
See application file for complete search history.

(56) References Cited

U.S. PATENT DOCUMENTS

| | | | | |
|---|---|---|---|---|
| 951,202 | A * | 3/1910 | Shirk | 15/104.31 |
| 1,344,249 | A | 6/1920 | Stewart | |
| 1,376,995 | A | 5/1921 | Balsley | |
| 1,446,224 | A * | 2/1923 | Thompson | 15/104.31 |
| 1,599,307 | A | 9/1926 | Ward | |
| 2,128,650 | A | 8/1938 | Knoerzer | |

(Continued)

FOREIGN PATENT DOCUMENTS

CA 265254 A 10/1926

(Continued)

OTHER PUBLICATIONS

"Response dated Jan. 10, 2011 to Jul. 8, 2010 Office Action regarding Canada Application No. 2,644,036".

(Continued)

*Primary Examiner* — Gary Graham
(74) *Attorney, Agent, or Firm* — Dorsey & Whitney LLP

(57) ABSTRACT

A tool for cleaning a drainage structure comprises a rod having a center longitudinal axis, a barrel housing having a proximal opening and a distal opening, the barrel housing having a center longitudinal axis and coupled coaxially to the rod, the barrel housing having an outside dimension that can be accommodated within the drainage structure, the distal opening of the barrel housing having a sinusoidal tearing contour. The tool further comprises a plurality of cutting implements radially coupled to and between the rod and the barrel housing, the cutting implements having a distal cutting edge and being angularly oriented to facilitate sweeping debris in a selected direction, and the barrel housing and cutting implements operable to rotate about the center longitudinal axis of the rod to dislodge and loosen debris inside the drainage structure.

8 Claims, 17 Drawing Sheets

U.S. PATENT DOCUMENTS

| | | | | | |
|---|---|---|---|---|---|
| 2,132,795 | A | | 10/1938 | Minier | |
| 2,169,543 | A | | 8/1939 | Sullivan | |
| 2,201,680 | A | * | 5/1940 | Haynes | 15/104.061 |
| 2,292,713 | A | | 8/1942 | O'Leary | |
| 2,402,314 | A | | 6/1946 | Crane | |
| 2,702,180 | A | * | 2/1955 | Horner | 175/69 |
| 2,836,838 | A | | 6/1958 | Kollmann | |
| 3,042,234 | A | | 7/1962 | Davis | |
| 3,160,904 | A | | 12/1964 | Swanson | |
| 3,171,149 | A | | 3/1965 | Ciaccio | |
| 3,181,192 | A | | 5/1965 | Truman | |
| 3,314,095 | A | | 4/1967 | Prange | |
| 3,916,471 | A | | 11/1975 | Maze | |
| 4,104,757 | A | | 8/1978 | Silverman | |
| 4,271,556 | A | * | 6/1981 | Farrell, Jr. | 15/104.31 |
| 4,274,797 | A | | 6/1981 | Coon | |
| 4,292,704 | A | | 10/1981 | Joanis, Sr. | |
| 4,677,997 | A | | 7/1987 | Strauss | |
| 5,056,176 | A | | 10/1991 | Belcher | |
| 5,178,484 | A | | 1/1993 | Strunk | |
| 5,379,476 | A | * | 1/1995 | Salecker | 15/104.31 |
| 5,418,997 | A | * | 5/1995 | DeFrange | 15/104.31 |
| 5,421,904 | A | | 6/1995 | Carlson | |
| 5,626,442 | A | | 5/1997 | Boyer | |
| 6,000,152 | A | | 12/1999 | Tate | |
| 7,398,785 | B2 | | 7/2008 | Harr | |
| 7,725,978 | B2 | | 6/2010 | Harr | |
| 2003/0196834 | A1 | * | 10/2003 | Drumm et al. | 175/19 |
| 2005/0097689 | A1 | | 5/2005 | Harr | |
| 2006/0157083 | A1 | | 7/2006 | Harr | |
| 2006/0157096 | A1 | | 7/2006 | Harr | |
| 2007/0186963 | A1 | | 8/2007 | Harr | |

FOREIGN PATENT DOCUMENTS

| | | | |
|---|---|---|---|
| CA | 1126912 | | 7/1982 |
| CA | 2469603 | A1 | 12/2004 |

OTHER PUBLICATIONS

Non-Final Office Action dated Mar. 14, 2011 for Canadian Patent Application No. 2,644,036.

Response dated Sep. 14, 2011 to Mar. 14, 2011 Non-Final Office Action for Canadian Patent Application No. 2,644,036.

* cited by examiner

DRAINAGE STRUCTURE CLEANING TOOL

This application is a continuation of U.S. Ser. No. 11/906,922, filed Oct. 4, 2007, now U.S. Pat. No. 7,721,375 which is a continuation of U.S. Ser. No. 11/375,886, filed Mar. 15, 2006 now abandoned which is a continuation-in-part of U.S. Non-Provisional patent application Ser. No. 10/857,411, filed on May 27, 2004 now abandoned, and further claims the benefit of U.S. Provisional Patent Application Ser. No. 60/476,568, filed Jun. 6, 2003, U.S. Provisional Patent Application Ser. No. 60/476,937, filed Jun. 9, 2003, and U.S. Provisional Patent Application Ser. No. 60/492,422, filed Aug. 4, 2003, all of which are incorporated herein by reference.

BACKGROUND

Culverts, pipes, ditches, and other drainage structures are in wide use for such reasons as preventing soil erosion and controlling runoff. Drainage structures may be installed under roadways and railroads to prevent flooding or to prevent water damage to the surrounding area. In other locations, drainage structures may be used to prevent alteration of the landscape by erosion, or shifting of the soil, for example. In some areas, controlling runoff from snowmelt is another issue that may be addressed, in part, by the use of drainage structures.

In some cases, a drainage structure may lose its function because it is clogged with debris. Drainage structures may become obstructed by soil, rocks, sand, intrusion of plant roots, snow, ice, or other debris. The location of some drainage structures may make them particularly susceptible to blockage. One way to address these problems is to place a covering or grating over the openings of the drainage structure. However, these coverings may require extensive and frequent cleaning and may still allow smaller objects such as sand, silt, and gravel to enter the drainage structure. Additionally, coverings and gratings may not prevent plant roots from clogging the drainage structure. Drainage structures can be removed and replaced periodically but this often involves disturbing existing roadways and other structures. The resultant disruption to roadway or railroad traffic is costly and causes great inconvenience to travelers.

BRIEF DESCRIPTION OF THE DRAWINGS

Aspects of the present disclosure are best understood from the following detailed description when read with the accompanying figures. It is emphasized that, in accordance with the standard practice in the industry, various features may not be drawn to scale. In fact, the dimensions of the various features may be arbitrarily increased or reduced for clarity of discussion.

DETAILED DESCRIPTION

Figure 1A:
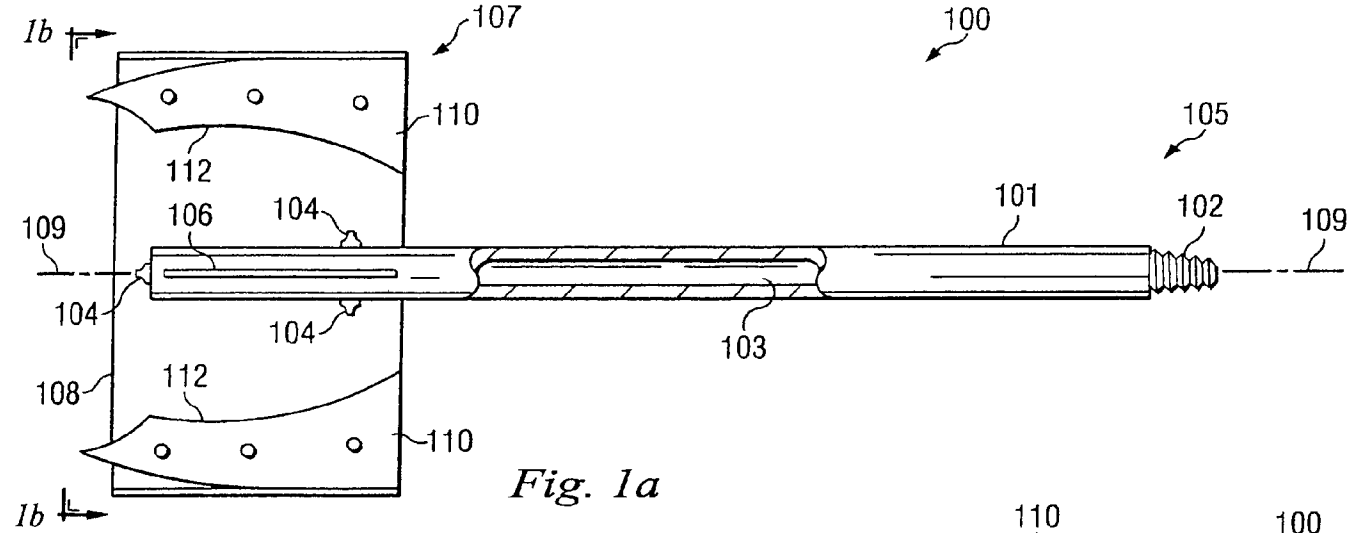
FIG. 1*a* is a cutaway view of an embodiment of a drainage structure cleaning tool.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 1B:
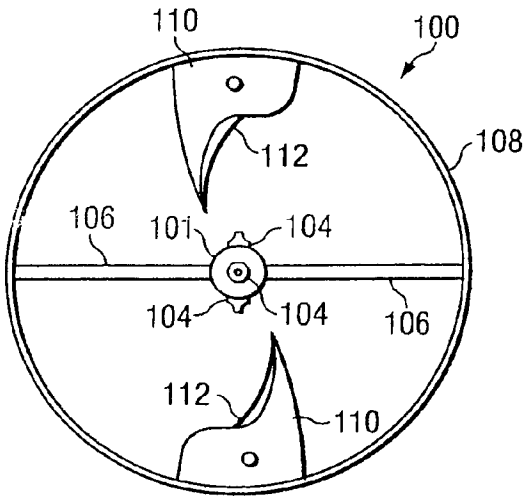
FIG. 1*b* is an end view of an embodiment of a the drainage structure cleaning tool of FIG. 1*a*.

Referring to FIGS. 1*a-b*, a drainage cleaning tool 100 comprises a drill rod 101 having a proximal end 105 and a distal end 107 and is couple to a substantially cylindrical housing 108 at its distal end 107. The drill rod 101 may have a length that is compatible for cleaning the length of a drainage structure to be cleaned. In one embodiment, the rod 101 may range between about 5 feet and 10 feet length and ranges from about 2 inches to about 2.5 inches in diameter. The rod 101 may be a commercially available drill rod section or may be custom made depending upon the needs of the user. The rod 101 may also be a commercially available pipe section or may be made from solid stock of steel, aluminum, or other metals or other suitable alloys thereof. In some applications plastics, polymers, fiberglass, or carbon fibers may also be used. The rod 101 comprises a coupler 102 at its proximal end 105 for coupling with an extension rod, a drilling rig or machine, or other available device, which is capable of performing horizontal or directional drilling. The coupler 102 may comprise a standard tapered threaded joint or some other type of coupling suitable for releasably attaching the rod 101 to an extension rod or to the drilling device. The coupling 102 may be integral with the rod 101 or attached as a separate component, by welding for example, and may be composed of similar materials as the rod 101. The rod 101 and the coupling 102 may have a fluid-conducting channel 103 defined therein to provide a means for introducing pressurized water, gases or other solutions into the drainage structure. One or more openings, nozzles or sprayers 104 in fluid communication with the channel 103 are formed in the distal end of the rod 101 to direct the pressurized fluids to the debris blocking the drainage structure.

The longitudinal central axis 109 of the drill rod 101 preferably coincides with the central longitudinal axis of the housing 108. The housing 108 may be substantially matched in diameter to the interior of the drainage structure being cleaned. For example, a cylindrical housing 108 may be chosen to approximately match the circular cross-section of certain drainage structures thus allowing a thorough cleaning in one pass. In some instances, however, with a large drainage structure, the housing 108 may be chosen to be smaller than the interior of the drainage structure to allow only portion of the drainage structure to be cleaned with each pass. In one embodiment, the diameter of the housing 108 may range from about 31 inches to about 48 inches and the length from about 14 inches to about 16 inches. The housing 108 may be made from a section of pipe of the appropriate diameter or may be custom made and may be composed of steel, iron, aluminum, or alloys thereof. If needed the housing 108 may also be made from plastic, polymers, or carbon fiber, for example.

The housing 108 may be coupled to the rod 101 by one or more supports 106. The supports 106 may extend radially from the rod 101 to the housing 108. Varying numbers of supports 106 may be used depending upon the application and needs of the user. The supports 106 may span the length of the tubular housing 108 but may also be shorter or longer. The supports 106 may be composed of similar or different materials than the housing 108 and rod 101. The supports may be coupled to the rod 101 and housing 108 by welds or by other means. As best seen in FIG. 1*b*, the housing 108 is secured to the rod 101 by two supports 106 spaced approximately 180.degree. apart from one another. Other configurations varying in position and number of supports are contemplated.

Figure 1C:
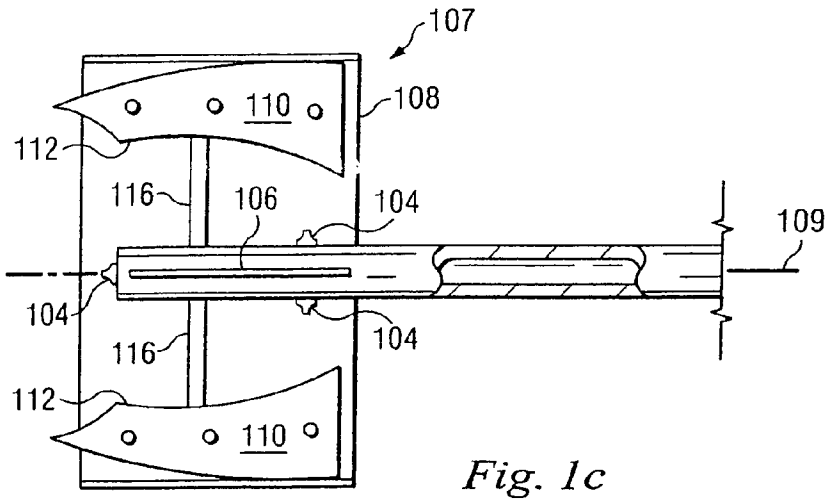
FIG. 1*c* is a side view, partly in section of the culvert cleaning tool of FIG. 1*a*.

A plurality of cutting implements 110 are coupled to the inner surface of the housing 108. The cutting implements 110 may be bolted or welded to the housing 108, or secured by some other means. The tubular housing 108 may serve as an anchor point and partial covering for the cutting implements 110. In this way, the cutting implements 108 are kept safely away from the walls of the drainage structure or pipe as well as any liner that may be in place. The housing 108 may also serve to cover and protect nozzles 104 and to keep them from becoming stopped up or clogged. The cutting implements 110 may remain within the housing 108 or extend beyond the distal end of the housing 108 as shown in FIG. 1*a*. The cutting implements 110 coupled to the inner surface of the housing 108 rotate as the housing 108 rotates. The cutting implements 110 may also be coupled to the rod 101 and rotate with the rod 101 while the housing 108 remains stationary. For example as shown in FIG. 1*c*, the cutting implements 110 are coupled to the drill rod 102 by radial supports 116. The cutting implements 110 may be paddles designed to sweep debris in a particular direction in coordination with the direction of rotation of the housing 108. In other embodiments, the implements 110 may comprise a narrower or sharpened cutting edge 112. The cutting edge 112 may also be serrated or equipped with teeth as the needs of the user dictate. The cutting implements or paddles 110 may have cutting edges 112 pointing inwardly toward the drill rod 101.

The cutting implements 110 may be constructed of similar or different material than the housing 108 and rod 101. The cutting implements 110 may also comprise high carbon steel or another durable material. For example, the cutting edge 112 may be constructed of high strength material such as high carbon steel or other suitable materials. The shape and position of the cutting implements 110 may dictate whether debris is swept forward (e.g., out from the distal end 107) or rearward, toward the proximal end of the rod, as the needs of the application dictate. The design of the cutting implements 110 may also be such that debris may be swept either forward or rearward depending upon the direction of rotation of the housing 108 if the coupler 102 is designed to enable rotation in either direction. In FIG. 1*a*, the drainage structure cleaning tool 100 is shown with two cutting implements 110, but more or fewer implements may be utilized in other embodiments.

The jets, nozzles, or sprayers 104 may be coupled to the distal end 107 of the rod 101 at various points. The positions as shown in FIG. 1*a* include a plurality of nozzles 104 within the housing 108 pointing radially outward from the rod 101 and one nozzle 104 point axially away from the distal end 107 of the rod 101. This configuration illustrates one possible arrangement of the nozzles 104 but other configurations are contemplated. Similarly, other embodiments may have more or fewer nozzles 104, or none at all. The nozzles 104 may be configured to provide a high pressure fluid stream in a desired direction. The nozzles 104 may be attached to the rod 101 by gluing, welding, or other means, and may be composed of similar or different materials than the rod 101. The nozzles 104 may also be configured to provide a specific spray pattern such as a narrow stream or a wide angle spray. The nozzles 104 may be configured to spray only in a desired direction, for example, into the housing 108, away from the housing 108, or in some other direction from the rod 101, which may increase the debris removal efficiency of the cleaning tool 100.

In operation, the drainage structure cleaning tool 100 may be used to clean a drainage structure, drainage structure pipe, drainage ditch, or other elongated and confined area that has become clogged with debris. The cleaning tool 100 (FIG. 1*a*) may be attached to a horizontal drilling device (not shown) by coupler 102 and, optionally, one or more extension rods. If the tool 100 is equipped with nozzles 104, a high pressure supply of cleaning fluid may be attached to the rod 101. A water tank with a pump may be used as the water supply. In some cases, the directional drilling machine may supply water to the nozzles 104 by pressurizing the water inside the rod 101 as previously described. The water nozzles may be checked for proper function and to ensure there is no blockage.

The cleaning tool 100 having been selected for size and for direction of debris removal may be inserted into the drainage structure. The drilling machine rotates the tool 100 within the drainage structure while injecting the pressurized water. The cutting implements 110 rotate with the housing 108 or rod 101 in a predetermined direction. In certain implementations where the coupler 102 is a threaded coupling, the housing 108 may be rotated clockwise to prevent the threaded coupling from loosening. Debris that is cut or dislodged will be deflected in the appropriate direction by cutting implements 110. The process may be repeated such that the device 100 is worked within the drainage structure in a "back and forth" motion until the drainage structure has been sufficiently cleaned. The nozzles 104 may be activated to assist with loosening of the debris and with debris removal by providing lubrication and pressurized force thereon. In some instances, the rod 101 may not provide sufficient length to clean the entire drainage structure. In such case, extension joints or tubing (not shown) that is compatible with the coupling 102 of the rod 101 and the drilling machine may be attached to coupling 102.

Figures 2A, 2B:
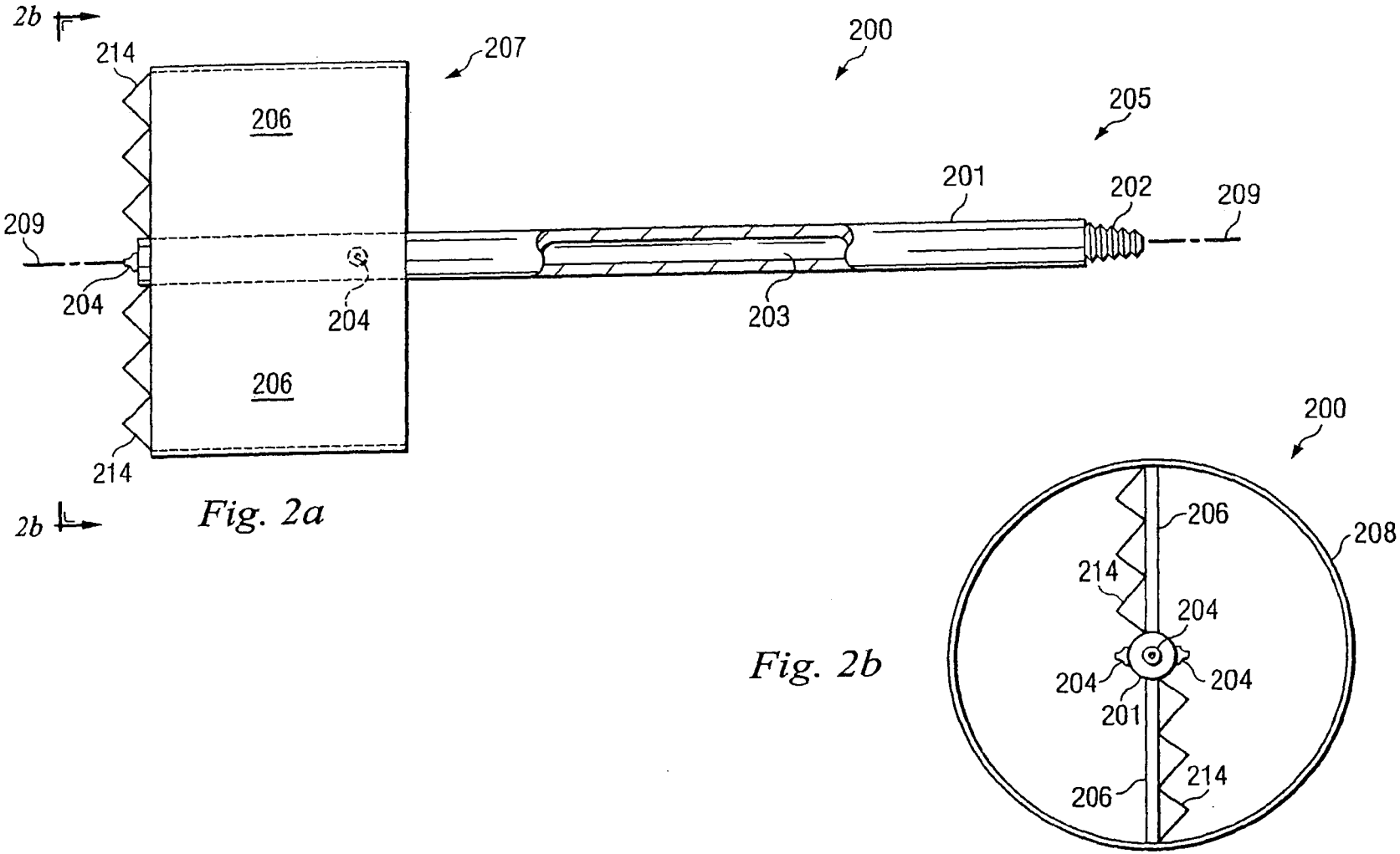
FIG. 2*a* is a cutaway view of an embodiment of another drainage structure cleaning tool.
FIG. 2*b* is an end view of an embodiment of the drainage structure cleaning tool of FIG. 2*a*.

FIG. 2*a* is a cutaway view of another embodiment of a drainage structure cleaning tool 200 and FIG. 2*b* provides and end view of the same. The drainage structure cleaning tool 200 comprises a drill rod 201 with a coupling 202 at a proximal end 205 thereof. The rod 201 may have a length that is compatible for cleaning the length of a drainage structure and may be joined to one or more extension rods (not shown) for elongating the reach of the tool. The rod 201 may range between about 5 feet and 10 feet length and ranges from about 2 inches to about 2.5 inches in diameter. The rod 201 may be a commercially available drill rod section or may be custom made depending upon the needs of the user. The rod 201 may also be a commercially available pipe section or may be made from solid stock of steel, aluminum, or other metals or other suitable alloys thereof. In some applications plastics, polymers, fiberglass, or carbon fibers may also be used. The rod 201 may comprise a channel 203 to allow pressurized fluids, such as water, gases, or other solutions to be conducted therethrough while the device 200 is in operation. The coupling 202 may be a tapered threaded joint or another type of coupling. The rod 201 and the coupling 202 may be integral or formed as separate pieces and attached together. The coupling 202 may also be hollow to allow the introduction of pressurized fluids into the rod 201. One or more nozzles 204 provided at various locations on the rod 201 are in fluid communication with the channel 103 of the rod 201 to conduct pressurized fluids to aid in debris removal.

The rod 201 is coupled by radial supports 206 to a housing 208. The rod 201 may be coupled coaxially along a center longitudinal axis 209 to the longitudinal axis of the housing 208. The housing 208 may serve to cover and protect nozzles 204 and to keep them from becoming stopped up or clogged. The tubular housing 208 may be chosen to approximately match the circular cross-section of certain drainage structures thus allowing a thorough cleaning in one pass. In some instances, however, with a large drainage structure, the housing 208 may be chosen to be smaller than the interior of the drainage structure to allow only portion of the drainage structure to be cleaned with each pass. In one embodiment, the diameter of the housing 208 may range from about 31 inches to about 48 inches and the length from about 14 inches to about 16 inches. The housing 208 may be made from a section of pipe of the appropriate diameter or may be custom made and may be composed of steel, iron, aluminum, or alloys thereof. If needed, the housing 208 may also be made from plastic, polymers, or carbon fiber, for example.

The tool 200 also comprises a plurality of forward-pointing teeth 214 to provide cutting surfaces for clearing and cutting debris. A series of cutting teeth 214 is attached to the supports 206 to aid in loosening and removing debris. The teeth 214 may be formed integrally with the supports 206 or they may be coupled thereto separately. The teeth 214 may be made of a durable material such iron, steel, aluminum, or alloys thereof. The teeth 214 may also be made from a high carbon steel, carbide, or diamond tipped for even greater durability. The teeth 214 and supports 206 may be constructed such that the teeth 214 protrude beyond the housing 208 at the distal end 207. Thus, the teeth 214 are exposed to blockage in the drainage structure while the walls of the drainage structure remain protected by the housing 208. The teeth 214 may attach at an angle to the supports 206 to improve cutting characteristics and to deflect debris in a desired direction as it is cut. There may be more or fewer teeth 214 than shown here as well as more or fewer supports 206. The angle of the teeth 214 may be configured such that rotation in a specific direction by the housing 208 results in more efficient cutting and debris deflection. It is also contemplated that various characteristics of the embodiments disclosed herein may be incorporated or utilized together. For example, drainage structure cleaning tool 100 may comprise teeth 214 on its supports 106 as shown in FIGS. 1*a*-1*b*.

In operation, the cleaning tool 200 may be coupled to a directional drilling machine and to a high pressure water source. The cleaning tool 200 may be inserted into the drainage structure into contact with debris to be removed. The drilling machine then rotates the cleaning tool 200 to commence clearing debris. The teeth 214 may cut through dirt, rocks, plants roots, animal nests, or other debris while moving forward and rotating. As before, this process may be repeated such that a back and forth motion is accomplished to ensure proper cutting of the debris and clearing of the drainage structure. One or more extension rods may be coupled to the drill rod 201 to extend the reach of the tool 200 into the drainage structure. The nozzles 214 may be activated to provide additional cleaning power or to assist in sweeping debris in a desired direction. Debris may be either pushed forward away from the device 200 or drawn towards the original opening depending upon the needs of the cleaning project. Additionally, the cleaning tool 200 may be used alternately with the cleaning tool 100 described above if needed.

Figure 3A:
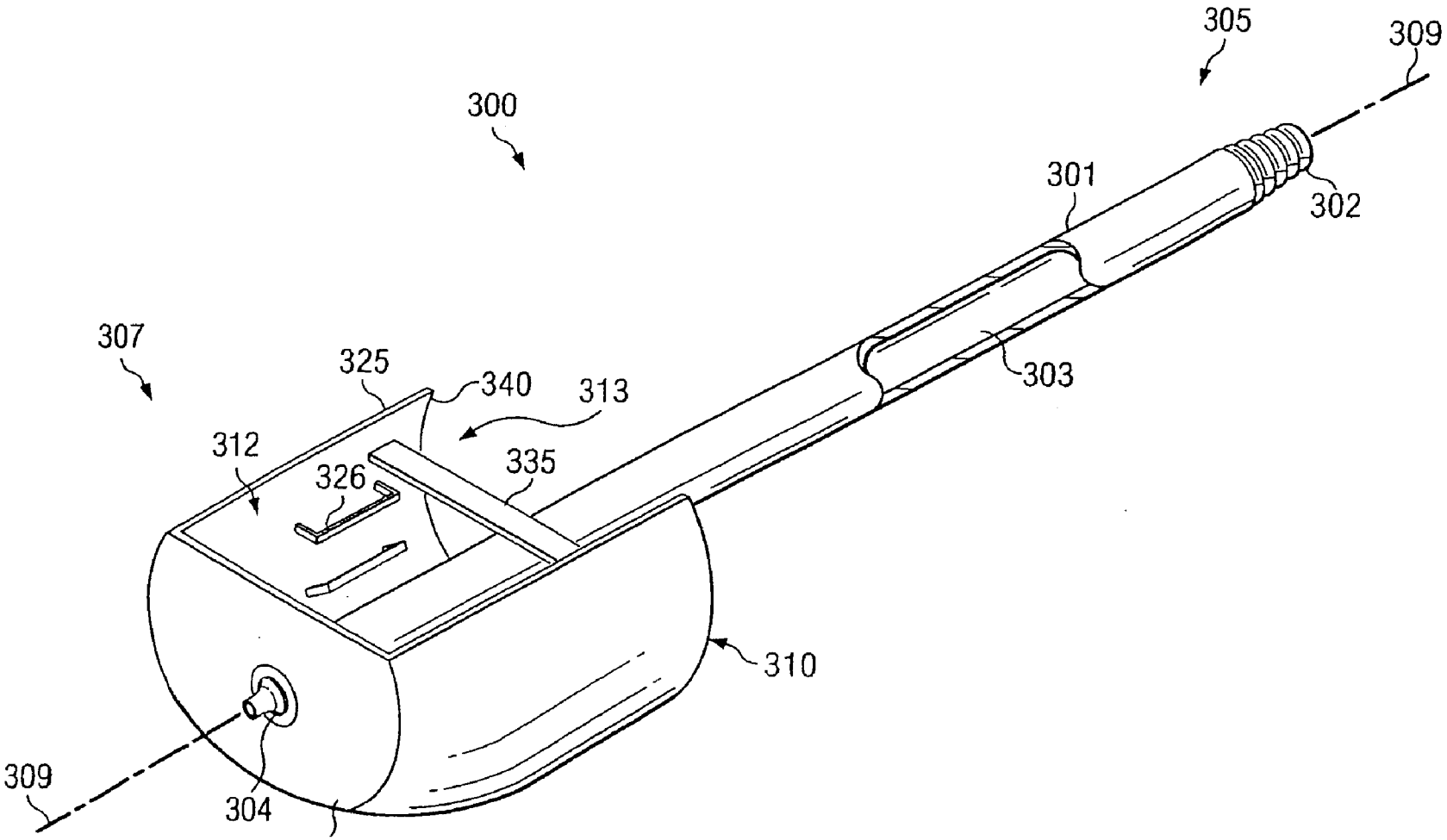
FIG. 3*a* is a perspective view of an embodiment of another drainage structure cleaning tool.
Figure 3B:
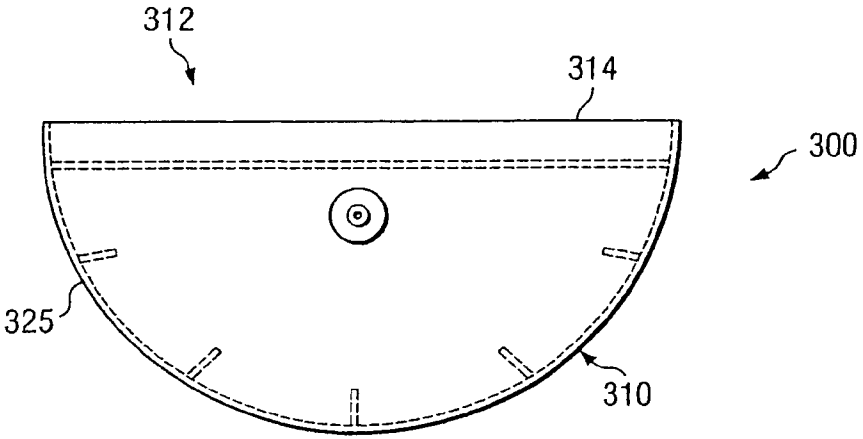
FIG. 3*b* is a side view of an embodiment of the drainage structure cleaning tool of FIG. 3*a*.
Figure 3C:
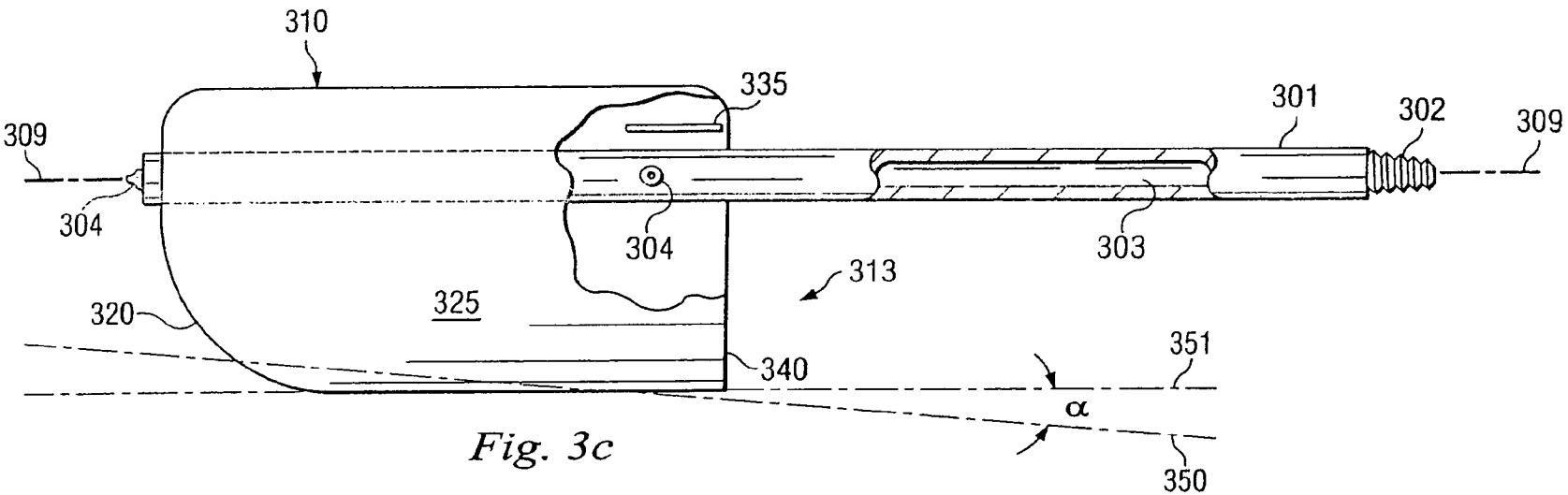
FIG. 3*c* is a side view of an embodiment of the drainage structure cleaning tool of FIG. 3*a* with alternate cutting implement placement.

FIGS. 3*a*-3*c* presents various views of another embodiment of a drainage structure cleaning tool 300. The cleaning tool 300 is a "pull bucket" and comprises a drill rod 301 with a proximal end 305, a distal end 307 and a longitudinal axis 309 therethrough. The drill rod 301 may have a length that is compatible for cleaning the length of a drainage structure and may be joined to one or more extension rods (not shown) for elongating the reach of the tool. The rod 301 may range between about 5 feet and 10 feet length and may range from about 2 inches to about 2.5 inches in diameter. The rod 301 may be a commercially available drill rod section or may be custom made depending upon the needs of the user. The rod 301 may also be a commercially available pipe section or may be made from solid stock of steel, aluminum, or other metals or other suitable alloys thereof. In some applications plastics, polymers, fiberglass, or carbon fibers may also be used. The rod 301 may comprise a channel 303 to allow pressurized fluids, such as water, gases, or other solutions to be conducted therethrough while the device 300 is in operation. The coupling 302 may be a tapered threaded joint or another type of coupling. The rod 301 and the coupling 302 may be integral or formed as separate pieces and attached together. The coupling 302 may also be hollow to allow the introduction of pressurized fluids into the rod 301.

Optionally, the drill rod 301 may comprise one or more nozzles in fluid communication with the fluid-conducting channel 303 in the rod 301. The nozzles 304 may direct pressurized fluids into the drainage structure to aid in debris removal.

The drill rod 301 is coupled to a c-shaped scoop or bucket 310 defined by an end portion 320, sidewalls 325 with a plurality of catches 326, and a rearward rim 340. The sidewalls 325 of the bucket 301 do not meet and therefore define a side opening 312. Further, the bucket 301 defines a rearward opening 313 opposing the end portion 320. The end portion 320 and walls floor 325 may be made from iron, steel, or other materials. The end portion 320 and side walls 325 may also be made from other materials such as plastics or polymers if desired. The rod 301 may attach directly to the end portion 320 may pass therethrough to allow placement of an additional nozzle 304, for example. The end portion 320 may include a substantially flat plate having an appropriate shape for the bucket 310. The end portion 320 and/or sidewalls 325 may one or more pieces welded or otherwise joined together. In other embodiments, the rod 301 may be coupled to the bucket 310 at a different location, such as along the sidewall 325 opposite the bucket opening 312, for example.

A support 335 may be coupled across the bucket opening 312 opposite the end portion 320 to increase the structural integrity and load capacity of the cleaning tool 300. The support 335 may attach, by welding, for example, to the side walls 325 and pass over or under the rod 301. The support 335 may also be secured to the rod 301 such as by welding. In other embodiments, the cleaning tool 300 may comprise different or additional supports than the support 335 as shown.

In particular, referring to FIG. 3*b*, the bucket 310 may comprise sidewalls 325 that form an arc in cross-section with the lateral opening 312 formed by a chord 314 connecting the circumference of the bucket cross-section. The distal end of the bucket 310 is covered by the end portion 320 and the proximal end of the bucket 313 defines a rearward opening 313. In one embodiment, the diameter of the bucket cross-section may range from about 14 inches to 17 inches and the length from about 20 inches to 25 inches. The sidewalls 325 may be formed from a large pipe section or may be custom made in the shape desired. The sidewalls 325 may be formed integrally or separately and then assembled, by welding, for example. There may also be a series of catches or ribs 326 along the sidewalls 325 which may serve to prevent debris captured in the bucket from sliding out easily. The catches 326 may be made from iron, steel, or another suitable material.

As more clearly seen in FIG. 3*c*, the end portion 320 of the bucket 310 may have a curved profile. The curved forward profile of the bucket 310 may be advantageous for facilitating the advancement of the tool 300 into the drainage structure. It may also be seen that in this embodiment the rod 301 extends through the end portion 320. The floor 325 of the bucket 310 is shown in this embodiment as being substantially parallel to the rod 301. That is, the central axis 309 of the drill rod 301 is parallel to an axis 351 of the floor 325 of the bucket 310. However, the cleaning tool 300 may also be assembled to provide a tilting of the bucket floor 325 relative to the rod axis 309 by a predetermined angle .alpha. In this way, the rearward edge 340 of the bucket 310 is presented at an angle against the walls of the drainage structure to enhance the ability of the tool 300 to remove debris. The angle .alpha. may vary depending on the needs of the cleaning project.

Figure 4:
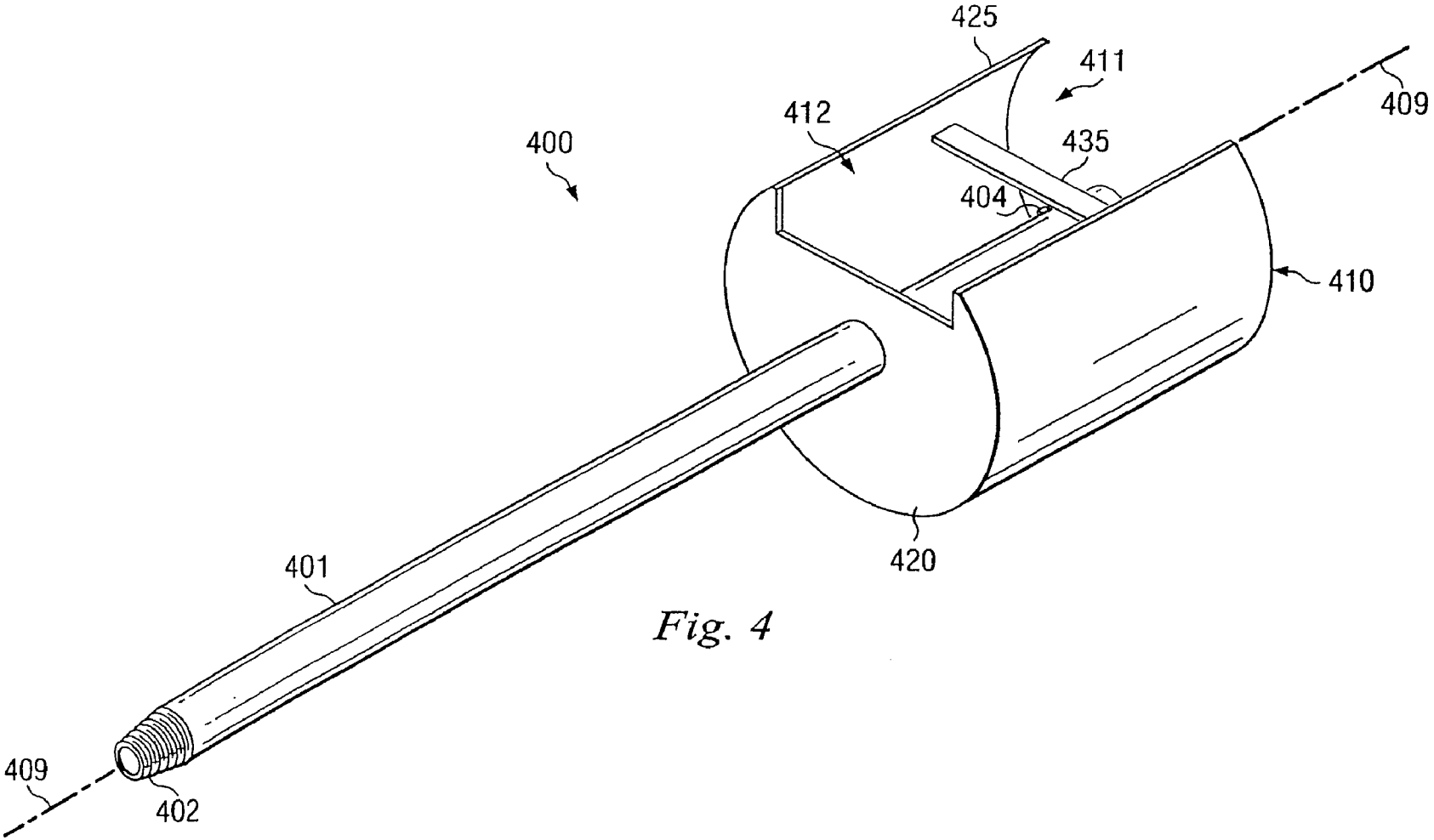
FIG. 4 is a perspective view of an embodiment of another drainage structure cleaning tool.

FIG. 4 is a perspective view of another embodiment of a drainage structure cleaning tool 400. Drainage structure cleaning tool 400 is a "push bucket" that is operable to push debris encountered in the drainage structure forward toward the distal end of the drainage structure. Cleaning tool 400 comprises a bucket 410 with a forward opening 411 and a side opening 412 coupled to drill rod 401. The push bucket 400 may comprises the same features as the pull bucket 300 described above. The floor and sides 425 of the tool 400 may also be tilted relative to the central axis 409 to increase cleaning efficiency.

Figure 5:
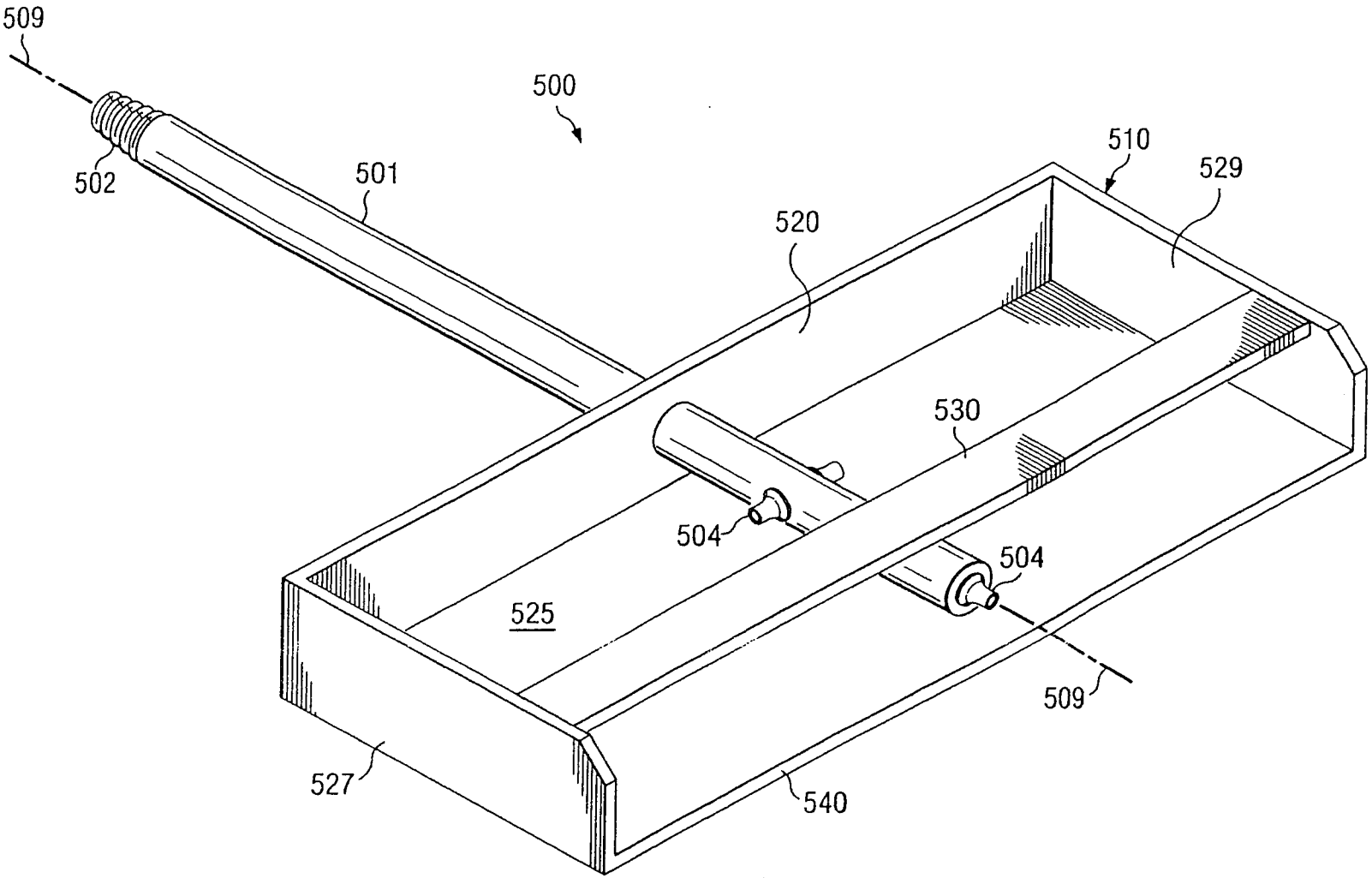
FIG. 5 is a perspective view of an embodiment of another drainage structure cleaning tool.

FIG. 5 is a perspective view of another embodiment of a drainage structure cleaning tool 500. The tool 500 comprises a bucket 510 with a generally rectilinear shape. The bucket 510 comprises a substantially flat end portion 520 through which a drill rod 501 passes, a substantially flat floor 525, and substantially flat sides 572, 529. The end portion 520, floor 525, and sides 527, 529 may be formed integrally or as separate pieces joined together, by welding, for example. In one embodiment, the rod 501 may be coupled to the bucket 510 on the floor 525 or in a different location. The flat floor 525 provides a flat scooping or scraping edge 540. The flat floor 540 and flat sides 527, 529 may join at right angles and thus define a substantially rectilinear-shaped scoop. The floor 525 of the tool 500 may be parallel to the central axis 509. However, in some embodiments, the floor 525 may be angled relative the central axis 509 to provide for more efficient gathering of debris when the device 500 is pushed within a drainage structure. Supports, such as support 530 may also be provided to increase load capacity or improve stability of the tool 500, for example. In another embodiment, the open end of the scoop will face toward the coupling 502, so as to allow the scoop to operate by being drawn or pulled rather than pushed.

In operation, the scoop or bucket-type cleaning tools 300, 400, 500 may be used to clean a drainage structure, drainage structure pipe, drainage ditch, or another elongated and confined space that has become clogged with debris. The tools 300, 400, 500 may be used to remove rocks or other large debris as well as debris that may be very dense or heavy, or is otherwise more effectively removed with a scooping tool than a rotating tool, such as tool 100. A tool (300, 400, 500) may be chosen based upon whether it is appropriate to push the debris out of the distal opening or draw it back out of the proximal opening of the drainage structure. Environmental concerns and the elevation and siting of the drainage structure openings may be determinative factors. The interior shape and dimensions of the drainage structure may also be considered. For example, in a drainage structure with a flat bottom, the rectilinear tool 500 may be used, whereas a round drainage structure may be most effectively cleaned with one of the cylindrical tools 300 and 400. As before, the size of the tool 300, 400, 500 may be chosen to match the clearance in and around the drainage structure or based on other user preferences.

The chosen tool (300, 400, or 500) may be attached to a directional drilling machine and extension pieces or tubing may be used if needed. If water nozzles (304, 404, or 504, respectively) are provided or needed, a high pressure water supply may then be attached to the tool 300, 400, 500 and the water nozzles tested for blockage and proper operation. The tool 300, 400, 500 may then be inserted into the drainage structure to a desired location. The orientation of the tool 300, 400, 500 relative to the interior of the drainage structure, or relative to the debris to be removed, may be adjusted by partial rotations of the tool 300, 400, 500 by the drilling machine. As the tool 300, 400, 500 is worked into the drainage structure, partial rotations may also be used to clear obstacles or structures within the drainage structure that may not be removable.

When the tool 300, 400, 500 has been inserted to the proper location, the floor 325, 525 of the tool 300, 400, 500 may be rotated towards the debris and the tool 300, 400, 500 may be positioned to scoop or scrape the debris in a desired direction. If the tool 300, 400, 500 becomes overly full, it may be lifted from the debris and removed from the drainage structure. The tool 300, 400, 500 may then be rotated to an "upside down" position to allow the debris to fall out or be removed. The tool 300, 400, 500 may then be reinserted and the process repeated until the drainage structure has been sufficiently cleaned. Water jets 304, 404, 504 may be used to assist in debris removal, for example by softening debris, or by sweeping it in a desired direction. In some cases, the debris in the drainage structure may need to be churned or loosened to allow ease of removal. The bucket or scooping tool 300, 400, 500 may be placed on or near the debris and rotated by the drilling machine to effect the desired mixing or churning action. Water jets 304, 404, 504 may be used here also if needed to increase the effectiveness of the operation. The bucket or scooping tools 300, 400, 500 may also be used in conjunction with the rotating tools 100, 200. One or more extension rods may be used with the tools 300, 400, and 500 to extend the reach of the tool inside the drainage structure.

Figure 6A:
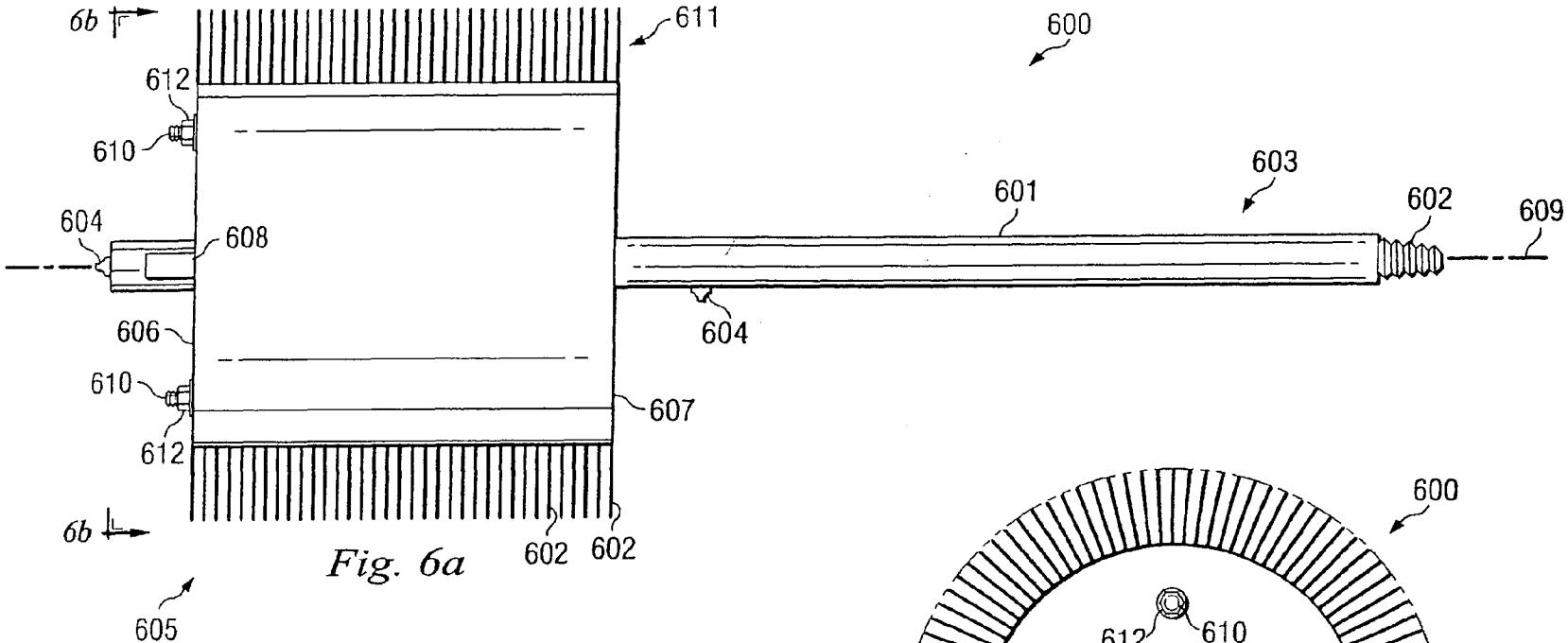
FIG. 6*a* is a side view of an embodiment of a drainage structure cleaning brush.
Figure 6B:
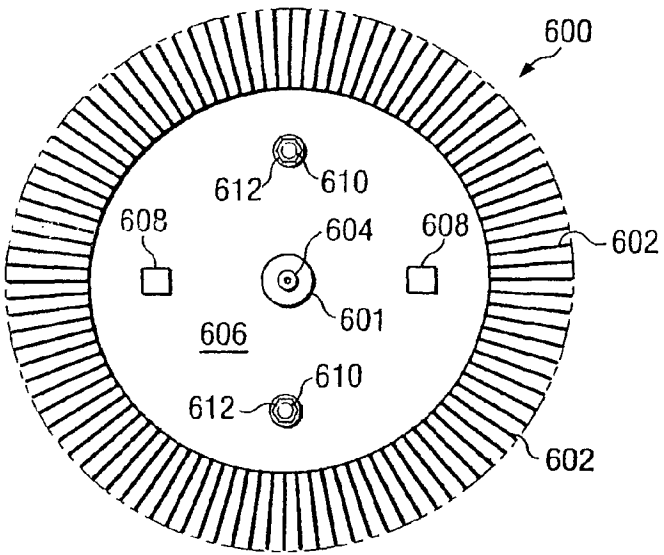
FIG. 6*b* is an end view of an embodiment of the drainage structure cleaning brush of FIG. 6*a*.

FIG. 6*a* is a side view of a drainage structure cleaning brush tool, or finishing brush tool 600. FIG. 6*b* is an end view of the brush tool 600. The brush tool 600 has a drill rod 601 with a proximal end 603 and a distal end 605. The proximal end 603 comprises a coupling 602, which may be a tapered threaded coupling or another suitable coupling. The rod 601 may comprise a fluid conducting channel and one or more fluid nozzles 604 at or near its distal end 605. The brush tool 600 comprises a brush assembly 611. The brush assembly 611 may comprise a plurality of brush segments 602 arranged concentrically about the rod 601. In one embodiment, brush segments 602 may range from about 30 inches to about 36 inches in diameter and may be about 2 inches in length. The brush segments 602 are sandwiched together by a forward end plate 606 and a rearward end plate 607. One or more drive rails 608 may be mounted to the rearward end plate 607 and are operable to pass through one or more corresponding openings in the forward end plate, as seen in FIG. 6*b*.

The forward end plate 606 may comprise steel, iron, aluminum, or another suitable material. In FIG. 6*b*, it may be seen that the drive rails 608 may be rectilinear in shape, but they may be cylindrical or other shapes. Although, two drive rails 608 are shown equidistant from the rod 601 and offset 180.degree. from one another, there may be more or fewer drive rails and their positions may differ from those shown. Similarly, there are two sets of threaded bars 610 and fasteners 612. The threaded bars 610 may be made from standard bolts if the desired length of bolt is available, or the threaded bars 610 may be made from commercially available all-thread, for example. The fasteners 612 may be threaded nuts or other devices for holding the brush segments together. In another embodiment, the fasteners 612 may be cotter pins for use with a hole (not shown) in the bolt 610, for example. In yet another embodiment, the threaded bars 610 may not be necessary if, for example, the end plate 606 is welded directly to the mounting bars 608.

Figure 6C:
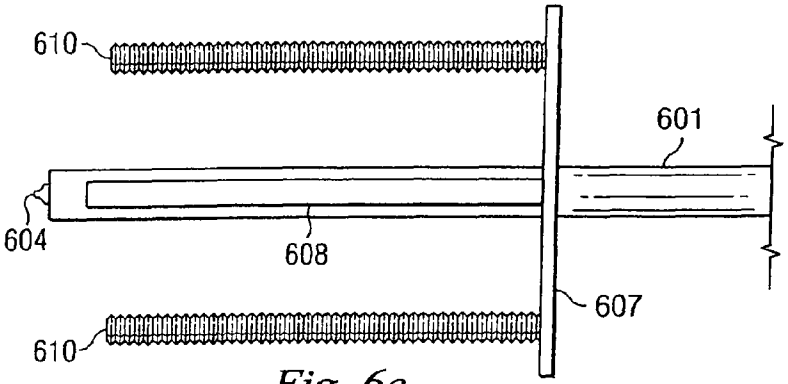
FIG. 6*c* is a partially disassembled view of an embodiment of the drainage structure cleaning brush of FIG. 6*a*.

FIG. 6*c* is a partially disassembled view of the drainage structure cleaning brush 600 of FIG. 6*a*. A portion of the rod 601 is shown with a nozzle 604. The rearward end plate 607 is shown in position and may be attached to the rod 601, for example, by welding. The end plate 607 may be substantially similar in composition and dimension as forward end plate 606. Drive rails 608 and threaded bars 610 may be coupled to the end plate 607, by welding, for example.

Figure 7:
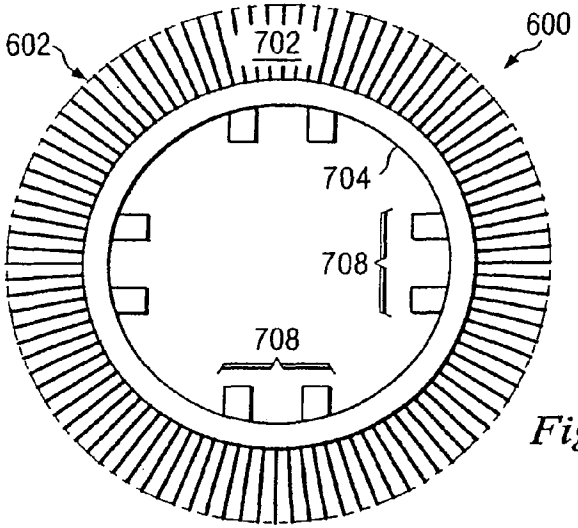
FIG. 7 is a top view of an embodiment of a brush section.

FIG. 7 is a top view of a brush segment 602. Bristles 702 may be coupled to a mounting ring 704. The mounting ring 704 may have a series of fingers 708 spaced around the inner circumference of the ring 704 so as to engage the mounting bars 608, and threaded bars 610 (FIGS. 6*a-c*). The bristles 702 may be made of nylon, or some other suitable synthetic or natural material. The mounting ring 704 may be made of plastic, a metal, or another suitable material. The fingers 708 may likewise be composed of a plastic, metal, or other suitable material. The diameter of the bristled portion 702 of the brush segments 602 may range from about 18 inches to about 36 inches, while the diameter of the inner ring may range from about 8 inches to about 12 inches. The thickness of the brush segment 602 may be about one inch. In one embodiment of the device 600 (FIGS. 6*a-c*), the drive rails 608 and threaded bars 610 are mounted to the end plate 607 in such a manner as to provide the proper spacing and radius that commercially available street sweeper sections may be used as the brush segments 602.

Figure 8A:
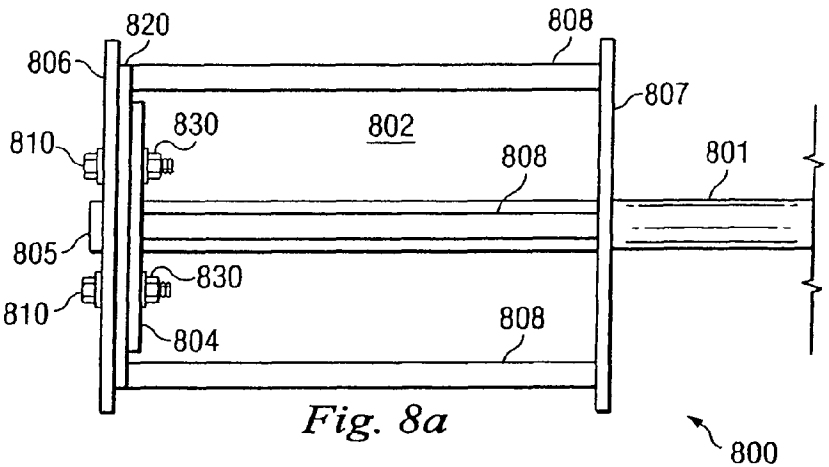
FIG. 8*a* is a transparent view of an embodiment of another drainage structure cleaning brush.

FIG. 8*a* is a transparent view of another embodiment of a drainage structure cleaning brush 800. The brush 800 is built onto a rod 801, which may have a length that is compatible for cleaning the length of a drainage structure and may be joined to one or more extension rods (not shown) for elongating the reach of the tool. The rod 801 may range between about 5 feet and 10 feet in length and ranges from about 2 inches to about 2.5 inches in diameter. The rod 801 may be a commercially available drill rod section or may be custom made depending upon the needs of the user. The rod 801 may also be a commercially available pipe section or may be made from solid stock of steel, aluminum, or other metals or other suitable alloys thereof. In some applications plastics, polymers, fiberglass, or carbon fibers may also be used. The rod 801 may comprise a channel 803 to allow pressurized fluids, such as water, gases, or other solutions to be conducted therethrough while the device 200 is in operation. In this embodiment, a multidirectional nozzle 805 is shown but other nozzles (e.g. 104 or FIG. 1) may be used and may be interchangeable with nozzle 105. The nozzle may be in fluid communication with the channel 803 in the rod 801.

Drainage structure cleaning tool 800 may also comprise end plates 804 and 806 to hold the brush segments together. However, a rod brace 802 may be utilized as a base for mounting drive rails, mounting bars, or splines 808. The rod brace 802 may be made of a pipe section of constructed from suitable materials such as a metal or plastic. The length and diameter of the rod brace may be selected to match the interior of the brush segments 602 described above. The drive rails 808 may be attached directly to the rod brace 608, by welding, or bolting for example. As shown, the endplates 804, 806 in combination with the rod brace 800 may provide a solid substantially cylindrical surface, to which brush sections 602 may be mounted. The drive rails 808 may be arranged to as to interface with the fingers 708 of brush section 602 (FIG. 7). The end plate 806 may be held in place by flange plate 804 which may be welded to the rod 801 for example. Captive nuts 830 on the flange plate 804 may be used for ease of assembly. Bolts 810 or other suitable fasteners may provide fastening on the opposite side. One or more washers may be used at various locations on the device 800. For example, rubber washer 620 may be used to prevent leakage of mud, water, or debris into the interior of the rod brace 802 when the device 800 is assembled for use.

Figure 8B:
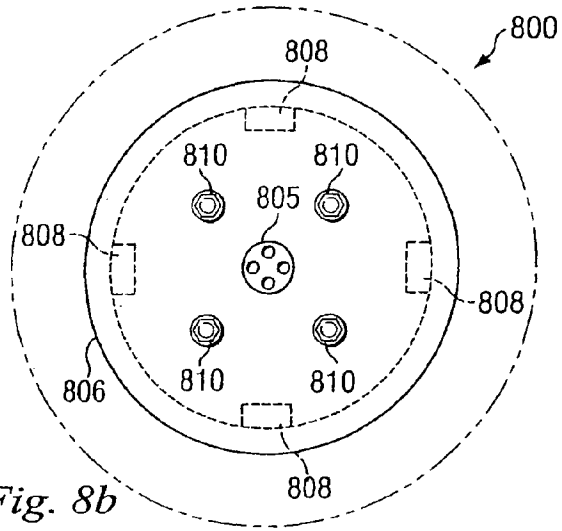
FIG. 8*b* is an end view of an embodiment of the drainage structure cleaning brush of FIG. 8*a*.

FIG. 8*b* is an end view of the drainage structure cleaning brush 800 of FIG. 8*a*. In this view, one possible configuration for the drive rails 808 can be seen but others are possible. As in previous embodiments, the drive rails may be positioned according to the design of the brush sections 802, possibly allowing commercially available street sweeper brush sections to be used. One possible bolt pattern for bolts 810 can also be seen here. The bolts 810 may be patterned to match the flange plate 831 (FIG. 8*a*), but other configurations than shown here are possible. Multidirectional nozzle 805 is also shown here which, in this embodiment, attaches directly to the end of rod 801. The multidirectional nozzle may allow for multiple high pressure fluid streams from a single location on rod 801.

In operation, the drainage structure cleaning brush 600 or 800 may be coupled to a piece of equipment such as a directional drill capable of drilling horizontally. The size of the brush used may be chosen to correspond the size of the drainage structure being cleaned. As before, extension rods may be added to the drill rod to increase the effective reach of the brush. The brush may also be attached to a high pressure water source (e.g., the drilling machine) so that the water nozzles 604, 805 may be used to aid in the cleaning. The nozzles 604, 805 may aid by sweeping the debris in a desired direction (e.g., away from the drilling machine, or towards it) or by softening hardened debris for easier sweeping. As described in greater detail below, the brushes 600, 800 may be used as part of a cleaning process that may involve first using other tools that have been described herein.

Figure 9:
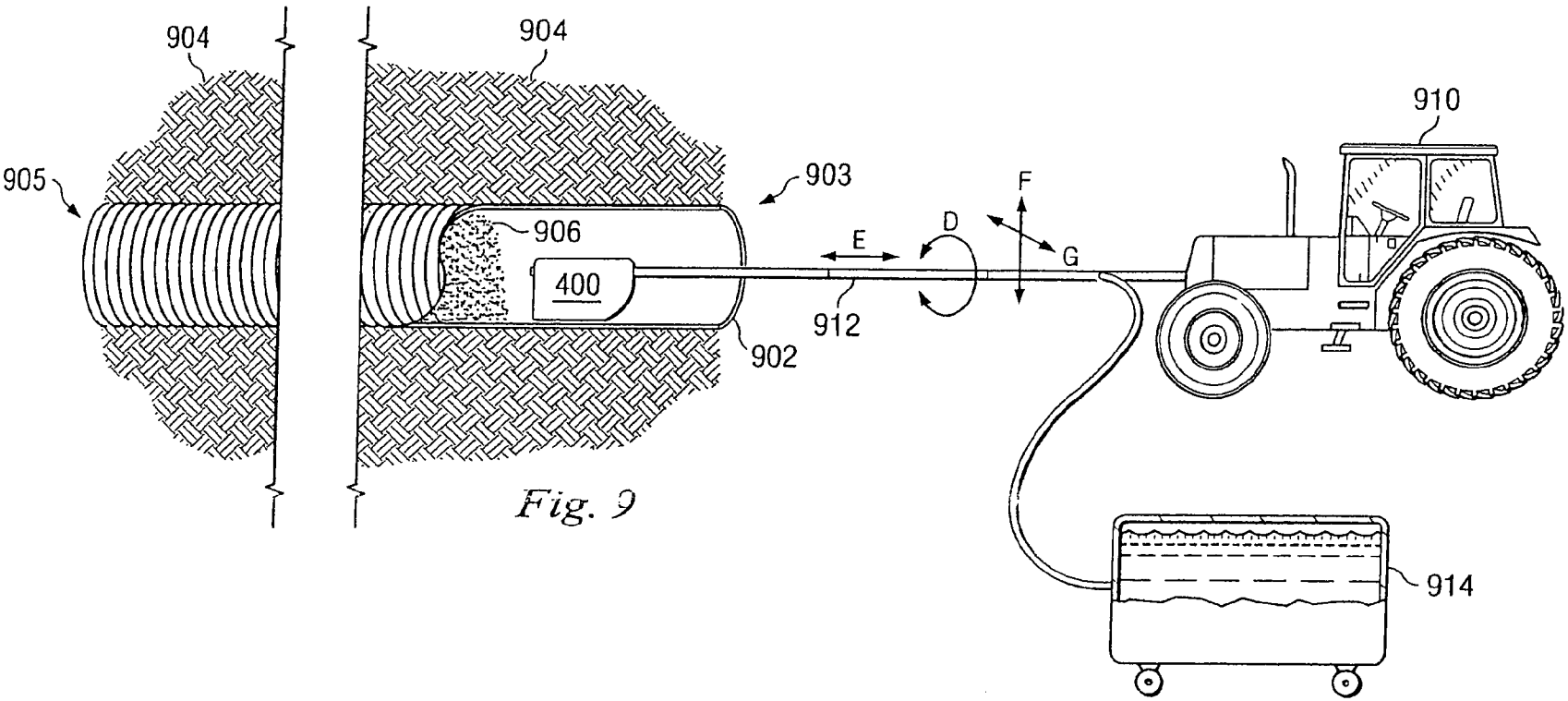
FIG. 9 is a view of one possible environment in drainage structure cleaning tools of the present disclosure may operate.

FIG. 9 is a view of one possible environment 900 in which embodiments of the above-described tools may operate. A drainage structure 902 may be a drainage structure passing under a roadway 904. The drainage structure 902 has a proximal end 903 and a distal end 905. Depending on environmental and other factors, the proximal end 903 or the distal end 905 may be selected as the debris exit point from the drainage structure 902. Preferably the drainage structure end having the lower elevation is chosen as the debris exit point in order to take advantage of the force of gravity, but this selection is not required. The debris 906 may partially or fully block the drainage structure 902. As shown, the proximal end 903 of the drainage structure 902 is accessible to a directional drilling machine or rig 910. Removal of grating or other safety implements (not shown) to expose the proximal opening of the drainage structure may be necessary, as well as excavation of the immediate area to allow proper access to the drainage structure 902. In this example, the cleaning tool 400 (as in FIG. 4) is shown attached to a drill rod of the drilling rig 910. One or more extension rods 912 may be used here to increase the effective reach of the tool 400. As stated previously, a high pressure water supply 914 may also be attached to the cleaning tool 400, via the extension rods 912, for example. The drilling rig 910 may manipulate the cleaning tool 400 in such a manner as to effect removal of the debris 906. The drilling rig 910 may be able to supply movement to the cleaning tool 400 along several different axes as shown by arrows D, E, F, and G. Depending upon the tool attached to the rig 910, the debris may be pushed or pulled from the proximal end of the drainage structure.

Figure 10:
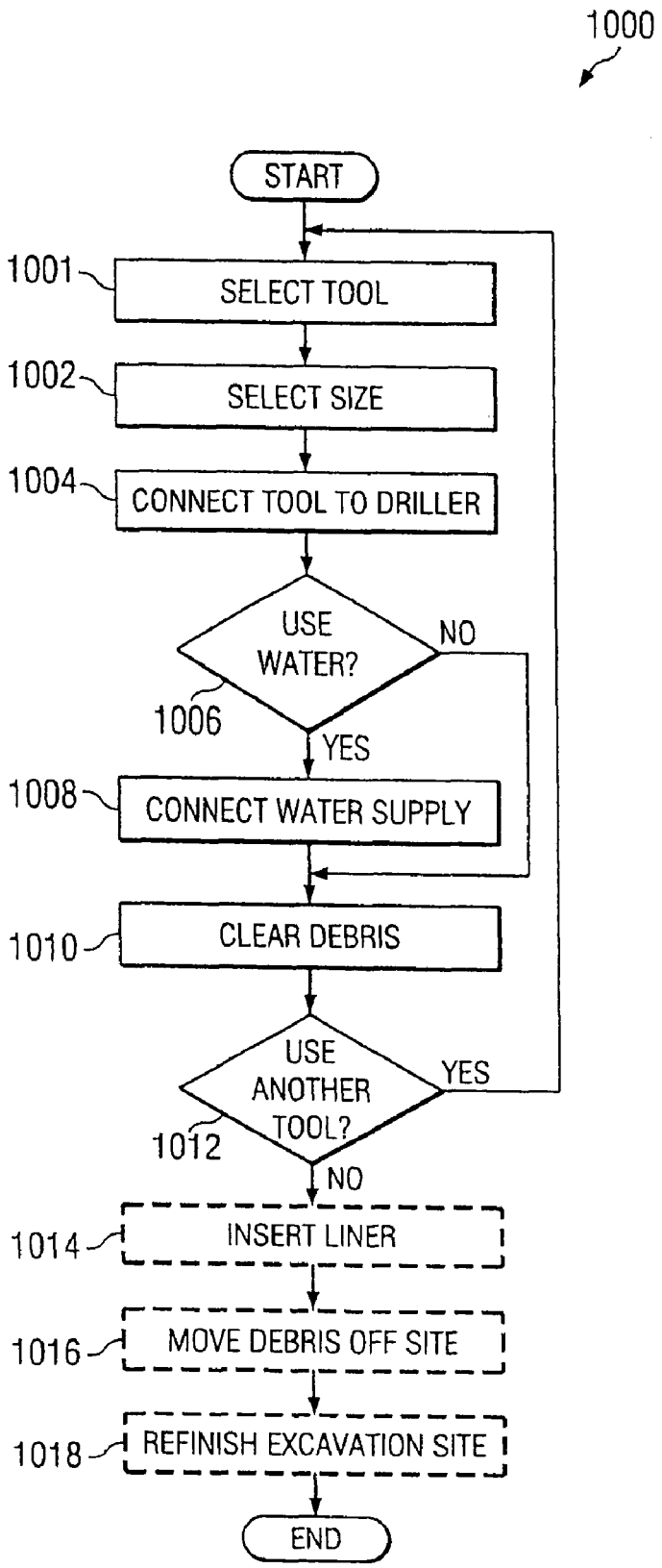
FIG. 10 is a flowchart illustrating a method for cleaning a drainage structure.

FIG. 10 is a flow chart of one embodiment of a method for cleaning a drainage structure. The appropriate tool may first be selected at step 1001. The cleaning tools as previously described may be chosen depending upon the type of debris in the drainage structure, the size and location of the drainage structure, and environmental factors, for example. Once an appropriate tool has been chosen, an appropriate size may be selected at step 1002. The size of the tool needed may depend upon the size of the drainage structure and whether a portion or all of the drainage structure is to be cleaned in each pass of the tool. Additionally the type of debris may impact the choice of the size of the tool. For example, very dense debris may lead to a selection of a smaller tool to reduce weight in the tool. A drainage structure with an immovable obstacle inside may lead to the selection of a smaller size tool to enable adequate room to maneuver the tool inside the drainage structure.

One an appropriate tool and size has been selected, the tool may be connected to a drilling machine at step 1004, such as a horizontal drilling rig. The connection of the tool to the drilling rig may also involve the use of extension joints as previously described. If water is to be used to assist in the cleaning at step 1006, the water supply is connected at step 1008. In some embodiments, the drilling rig may also serve as a high pressure pump or water supply. Clean water may be used in some embodiments but waste water, water from a local body of water, or another supply of a suitable liquid may also be used. At step 1010, the tool may be inserted into the drainage structure and the cleaning action may commence. As previously described and depending upon the tool currently in use, drilling motions, sweeping motions, or scooping motions may be used to clear debris from the drainage structure. Additionally, it may be necessary for debris to be deposited only in one area as it is removed from the drainage structure. Environmental concerns, for example, may necessitate that removed debris is placed only at one end of the drainage structure and/or that the fluids used in loosening the debris not enter an existing natural body of water.

In some environments, the cleaning of a drainage structure may require the use of more than a single tool. For example, a scooping-type tool may be used, followed by a brush. In some embodiments, two different kinds of routing or rotating tools may be used followed by a brush tool. Some drainage structures may require the use of both scooping tool and routing tools followed by the brush tool and some cleanings may not require the brush at all. At step 1012, a decision may be made as to whether an additional tool is needed. If so, the additional tool may be selected as described beginning at step 1001.

The cleaning of some drainage structures may require additional, optional steps. For example, a liner may be inserted into the cleaned drainage structure at step 1014. A liner may help to prevent degradation of the drainage structure itself, or may helped to slow the subsequent buildup of new debris inside the drainage structure. In some environments, the debris may have to be removed from the cleaning site at step 1016. This may be due to environmental concerns, or concerns with keeping the area free of loose debris, for example. If the area around the end of the drainage structure was excavated to allow proper access, it may be necessary to restore the landscape to its original condition at step 1018. Any grills, coverings, or other safety implements may also be replaced at this step.

Figure 11A:
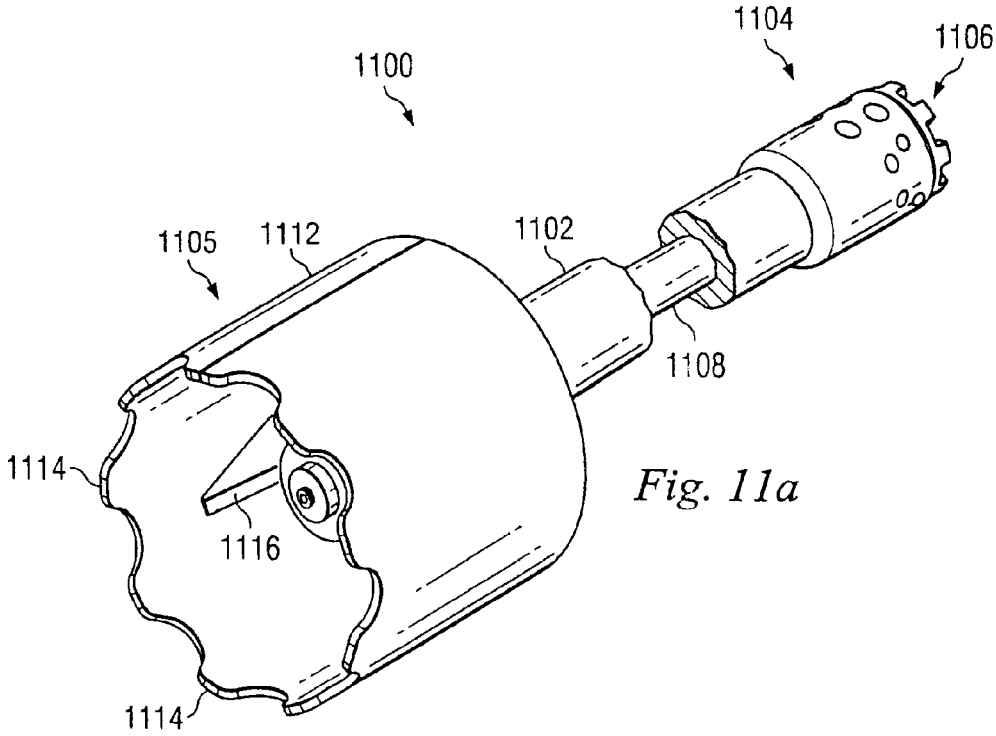
FIG. 11*a* is a perspective view of another embodiment of a drainage structure cleaning tool.
Figure 11B:
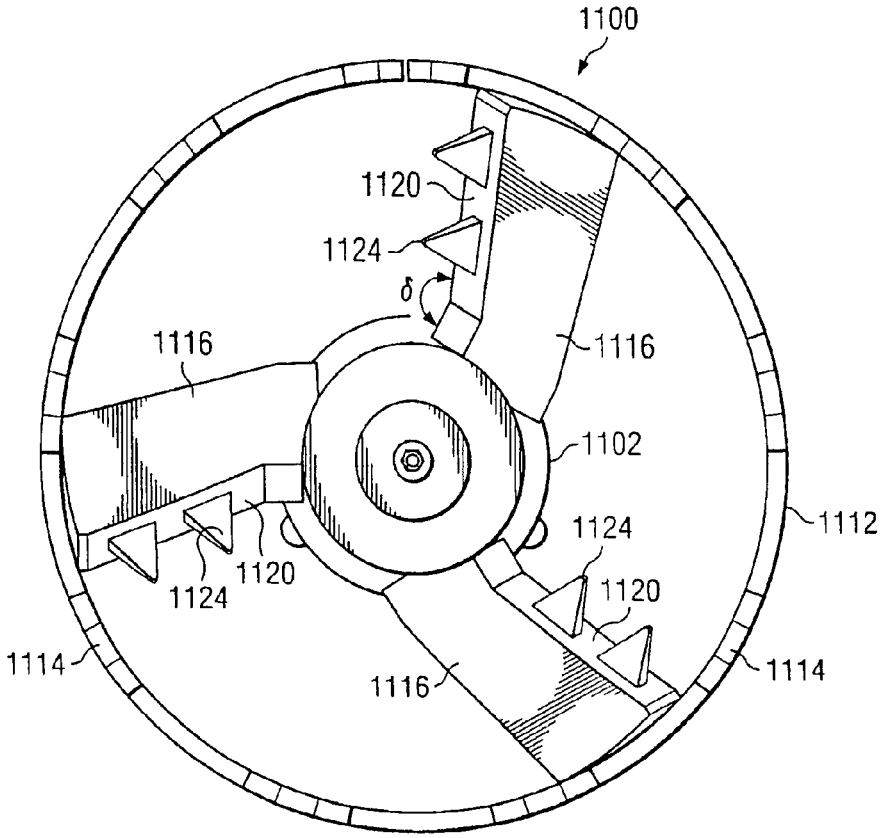
FIG. 11*b* is an end view of another embodiment of the drainage structure cleaning tool of FIG. 11*a*.
Figure 11C:
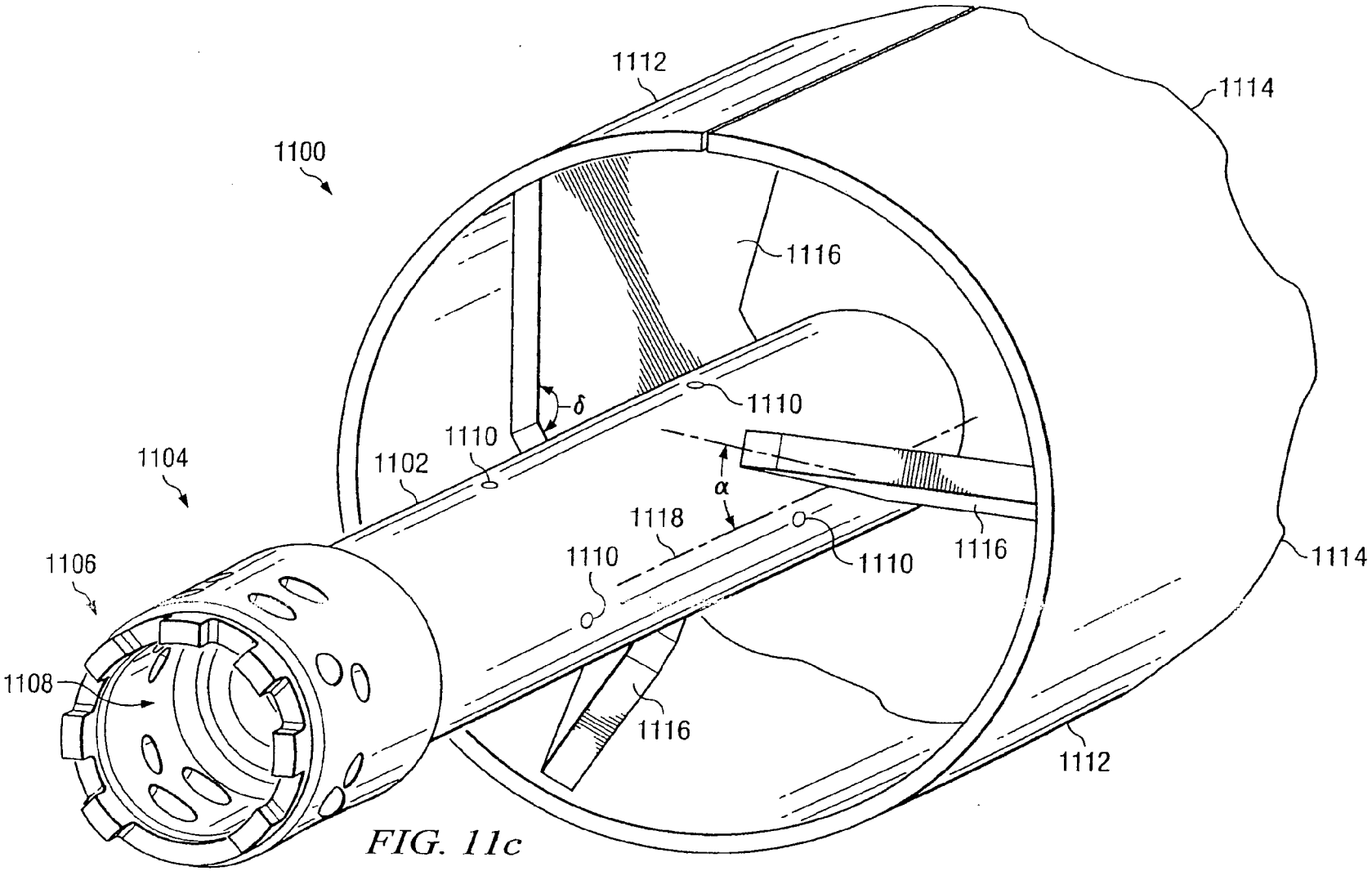
FIG. 11*c* is another perspective view of the drainage structure cleaning tool of FIG. 11*a*.

FIGS. 11*a*, 11*b*, and 11*c* are various views of another embodiment of a drainage structure cleaning tool 1100, also called a barrel cleaning tool. The tool 1100 comprises a drill rod 1102 having a proximal end 1104 and a distal end 1105. At the proximal end 1104, a coupler 1106, such as a splined connection of the type made by Earth Tool Corporation of Wisconsin under the model designation SPLINE-LOCK, may be used to couple tool 1100 to one or more drill string rods and to a directional boring machine or another type of equipment operable to rotate and steer the tool and drill string. The drill rod 1102 defines therein a longitudinal fluid-conducting channel 1108 to direct pressurized fluids to a plurality of nozzles 1110 disposed about the drill rod 1102 proximate its distal end 1105.

The tool 1100 further comprises a barrel housing 1112 coupled substantially coaxially to the drill rod 1102 at its distal end. The cross-sectional shape of the barrel housing 1112 may conform to the cross-sectional shape of the drainage structure to be cleaned. For example, a tool having a having a substantially circular cross-section may be used to clean and clear out a drainage structure with a circular cross-section. On the other hand, a tool having a having a substantially square or rectangular cross-section may be used to clean and clear out a drainage structure with a square or rectangular cross-section. The distal end of barrel housing 1112 is further shaped to define a plurality of integral ripping teeth 1114. The ripping teeth 1114 are shaped and contoured to define a sinusoidal profile with a plurality of peaks and valleys, where the peaks and valleys may be pointed or blunt in profile. The ripping teeth 1114 are operable to tear through and loosen vegetation, compacted soil and other obstructions inside the drainage structure.

At the distal end of the drill rod 1102, a plurality of cutting implements or paddles 1116 couple the barrel housing 1112 to the drill rod 1102. The cutting implements 1116 may be mounted onto the drill rod 1102 at an angle .alpha. from the longitudinal axis 1118 of the drill rod 1102. The angle .alpha. is preferably less than 90 degrees. This angled mounting of the cutting implements 1116 is best seen in FIG. 11*c*. The angle of attack of the cutting implements 1116 is designed to cut, loosen and sweep debris in the drainage structure in a general direction toward the proximal end of the drainage structure when rotation of the barrel housing 1112 and drill rod 1102 causes rotation of the cutting implements 1116 about the longitudinal axis of the drill rod. Referring to FIG. 11*b*, advanced (or distal) edges 1120 of the cutting implements 1116 are further equipped with a plurality of cutting teeth 1124. The cutting teeth 1124 may be attached to cutting implements 1116 and may have tips or inserts constructed of carbide, steel, polycrystalline diamond (PCD), and other suitable materials. The cutting teeth 1124 provides the cleaning tool 1100 added capability to cut through thick vegetation and compacted debris in the drainage structure. The cutting implements 1116 may have a L-shaped configuration where the angle, .delta., between the two legs of the cutting implement is greater than 90 degrees.

In operation, the drainage structure cleaning tool 1100 may be used to clean a culvert, pipe, drainage ditch, drainage structure, or another elongated and confined area that has become clogged with debris. The cleaning tool 1100 may be coupled or mounted to a horizontal drilling equipment by coupler 1106 and, optionally, one or more extension rods depending on the length of the drainage structure and the location of the blockage. If the cleaning tool 1100 is equipped with nozzles 1110, a high-pressure supply of cleaning fluid may be coupled to the drill rod 1102 to conduct the cleaning fluid in the channel 1108 to the nozzles. A storage tank equipped with a pump may be used as the cleaning fluid supply. The cleaning fluid may be water, steam, or another cleaning solution. The cleaning tool 1100 is selected for size and shape to suit the size and shape of the drainage structure to be cleaned. The drilling machine rotates the tool 1100 within the drainage structure while injecting the pressurized fluid that aids in further loosening the lodged debris. The cutting implements 1116 rotate with the barrel housing 1112 and the drill rod 1102 in a predetermined direction. Debris that is cut or dislodged are thus deflected and swept in the appropriate direction by cutting implements 1116. The process may be repeated such that the tool 1100 makes more than one pass within the drainage structure until most of the debris is sufficiently cleaned.

Figure 12A:
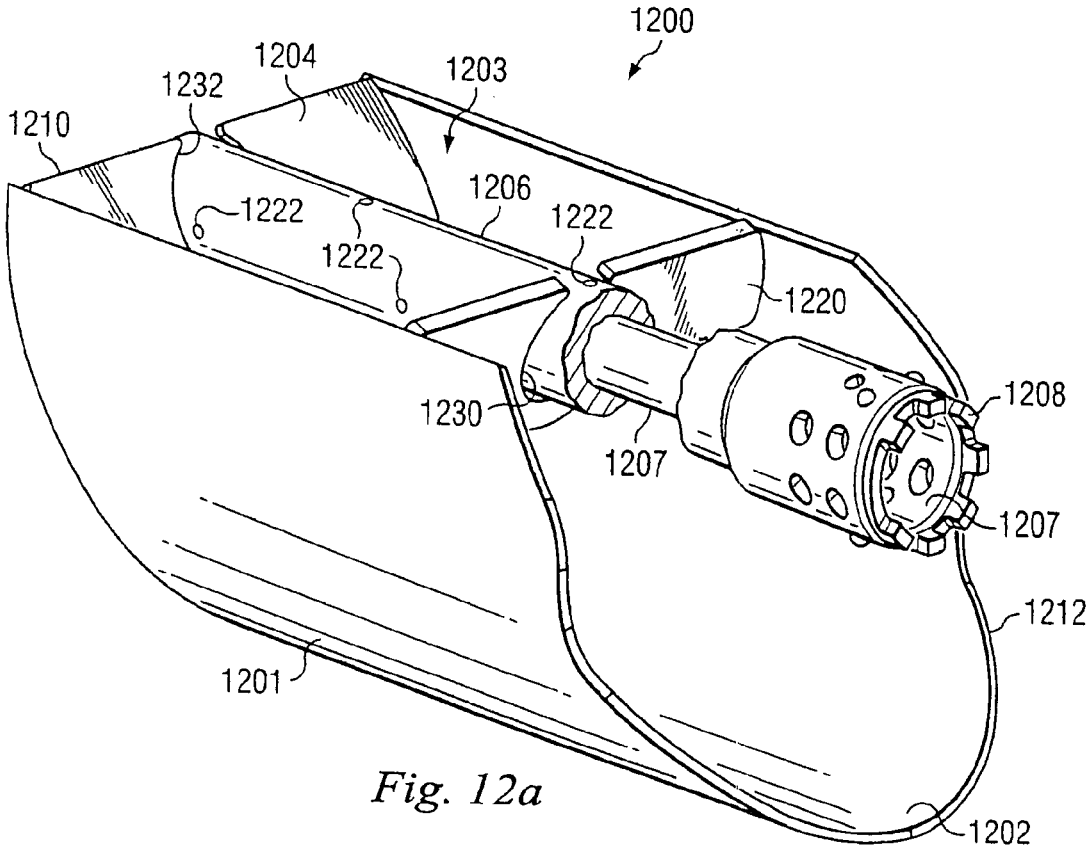
FIG. 12*a* is a perspective view of another embodiment of a drainage structure cleaning tool.
Figure 12B:
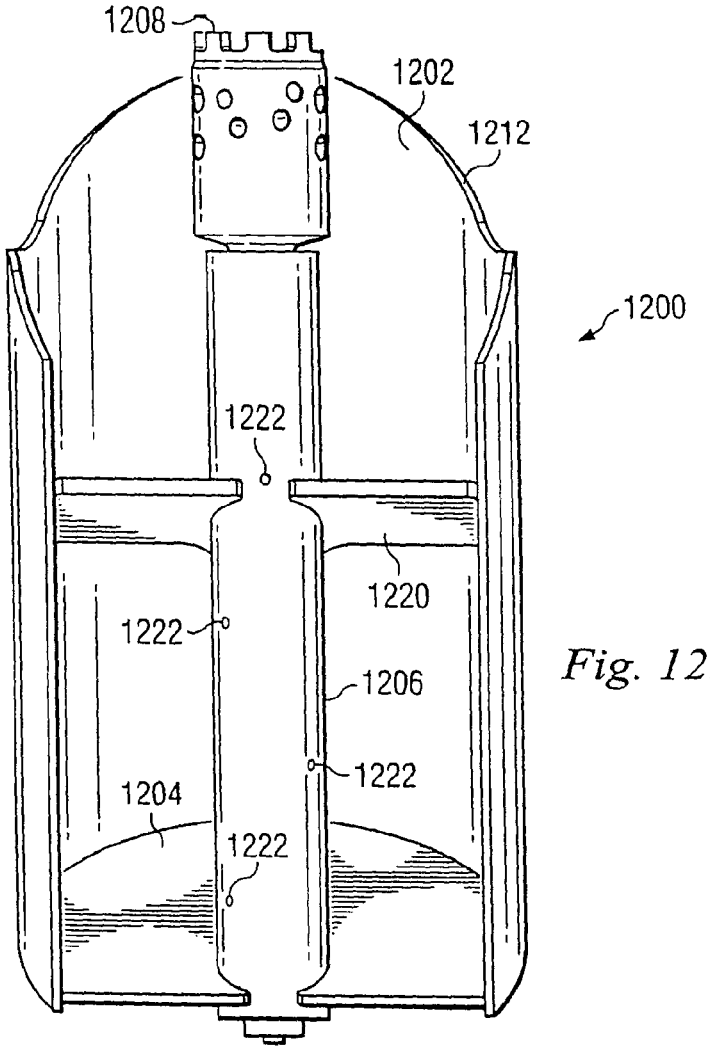
FIG. 12*b* is a top plan view of the drainage structure cleaning tool of FIG. 12*a*.
Figure 12C:
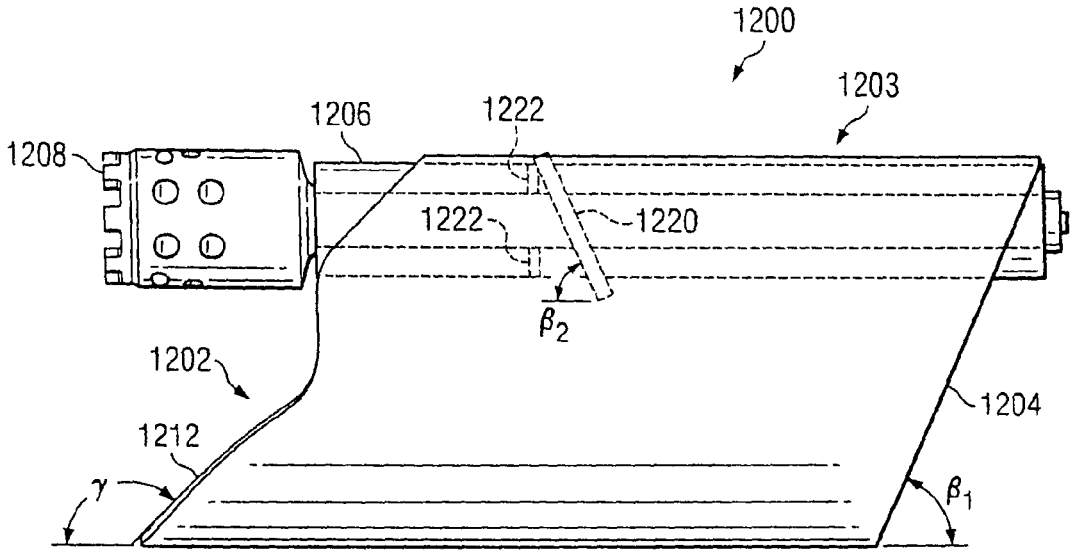
FIG. 12*c* is a side view of the drainage structure cleaning tool of FIG. 12*a*.

FIGS. 12*a*, 12*b*, and 12*c* are various views of an embodiment of another drainage structure cleaning tool 1200. Cleaning tool 1200 comprises a "pull bucket" 1201 coupled or mounted on a distal end of a drill rod 1206. The pull bucket 1201 has an overall substantially cylindrical shape with a proximal opening 1202, a side opening 1203 integral with the proximal opening 1202, and a distal closed end 1204. The closed distal end of the pull bucket 1201 preferably has an angled construction having an inclined angle .beta..sub.1 shown in FIG. 12*c*. The proximal opening 1202 of the pull bucket 1201 has a contoured profile, including a digging lip 1212. The digging lip 1212 may have a general profile having an inclined angle .gamma. relative to the side wall of the pull bucket as shown in FIG. 12*c*. The digging lip 1212 presents an advanced proximal edge of the pull bucket 1201 that is operable to provide leverage while the pull bucket 1201 is being pulled toward the horizontal drilling machine used to operate the cleaning tool 1200 and further provide a digging profile that facilitates the removal and loosening of compacted debris and soil.

The drill rod 1206 defines therein a longitudinal fluid-conducting channel 1207 that is in fluid-communication with a plurality of nozzles 1222 disposed about the distal end of the drill rod 1206. A proximal end of the drill rod 1206 comprises a splined connection that enable the drill rod to be quickly coupled to one or more drill string rods or extensions. Further, the drill rod 1206 is preferably mounted to the pull bucket 1201 along the side opening 1203 of the pull bucket 1201. This mounting location enables the drill rod 1206 and the support plate 1220 to not interfere with the loading and filling of the pull bucket 1201. The support plate 1220 are mounted so that its flat surfaces are at an angle .beta..sub.2 relative to the longitudinal axis of the rod 1206 (best seen in FIG. 12*c*). The support plate 1220 may be used to mount the drill rod 1206 to the bucket and provide structural reinforcement. The support plate 1220 may define an opening 1230 therein for accommodating the drill rod 1206. Similarly, the distal closed end 1204 of the pull bucket 1201 may define another opening 1232 for accommodating the distal end of the drill rod. The drill rod 1206, the support plate 1220 and the pull bucket 1201 may be secured to one another by welding or another suitable method. The support plate opening 1230 and the closed distal end opening 1232 may be connected to the side opening of the bucket to facilitate tool assembly.

In operation, the pull bucket tool 1200 may be used when the proximal end of the drainage structure has been selected as the exit site of the debris. Generally, after a tool of the type shown in FIGS. 1*a*-2*b* and 11*a*-11*c* has been used to loosen the debris compacted and lodged in the drainage structure, the pull bucket tool 1200 may be subsequently used to move and evacuate the dislodged debris toward the proximal end of the drainage structure. The digging lip 1212 of the pull bucket 1201 enables a substantial amount of the debris to be loaded and transported out of the drainage structure. On the other hand, the slanted closed distal end 1204 of the pull bucket 1201 enables some of the debris in the pull bucket tool 1200 to be pushed and spill out of the distal end of the pull bucket as to avoid overloading the bucket. Furthermore, the pull bucket tool 1200 may be advantageously used to dig into the side walls of the drainage structure to further loosen the debris therein. The pull bucket tool 1200 may be pulled to dig, using the digging lip, load the bucket, and then rotated to unload the debris collected therein, and then pulled to dig and load the bucket, rotated to unload the debris, and so on. Once most of the debris inside a segment of the drainage structure has been loosened, the pull bucket can be used to load and pull the dislodged debris out of the drainage structure.

Figure 13A:
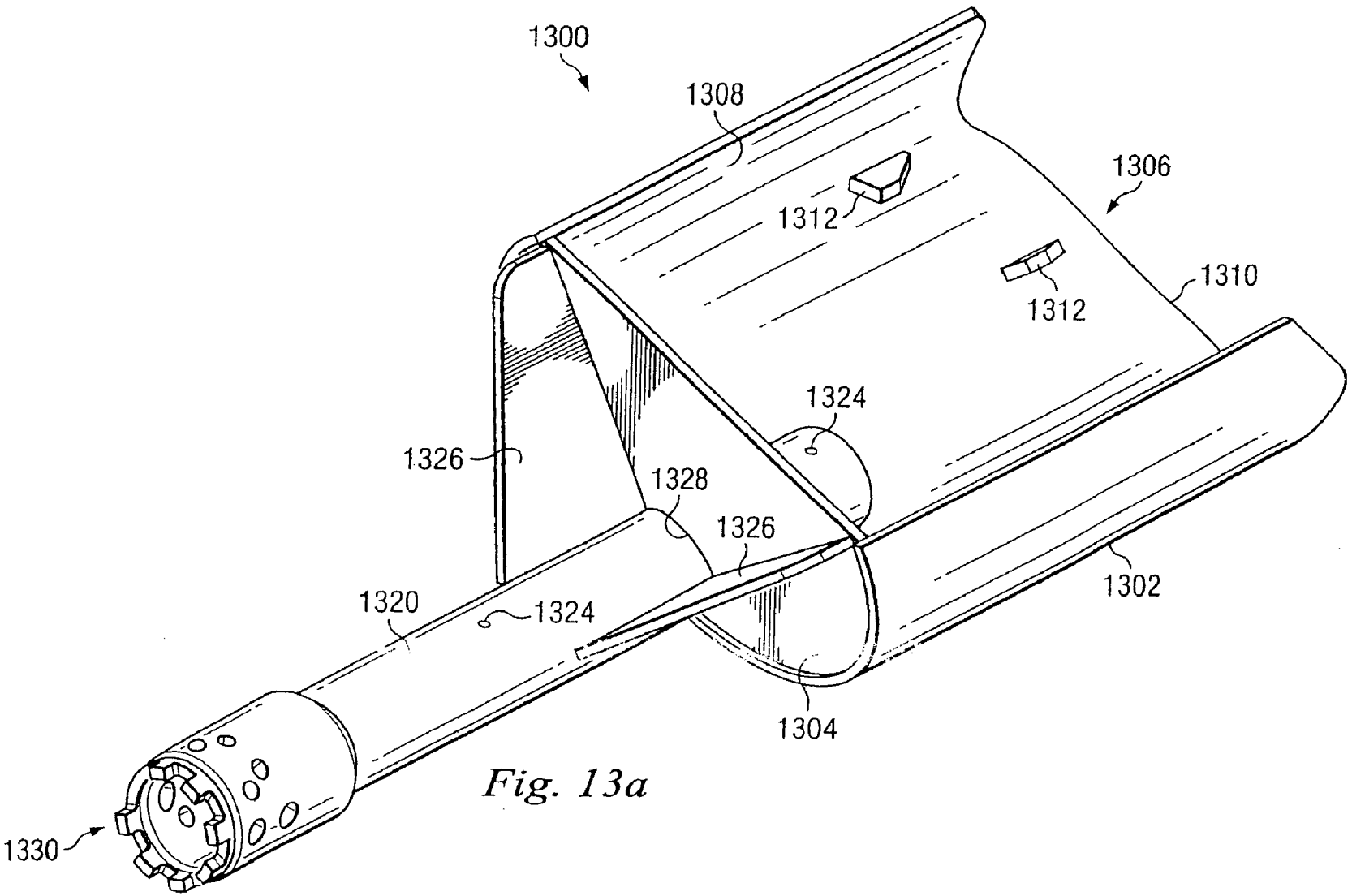
FIG. 13*a* is a perspective view of another embodiment of a drainage structure cleaning tool.
Figure 13B:
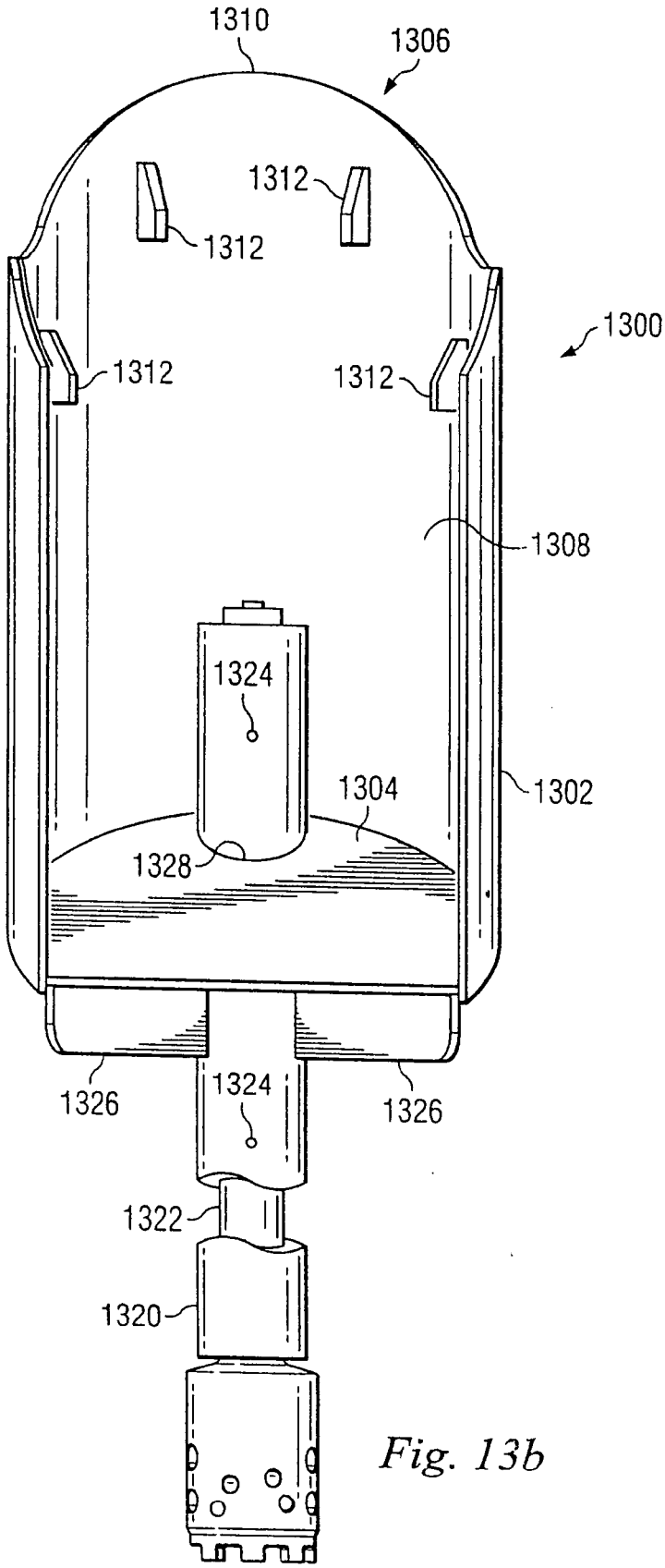
FIG. 13*b* is a top plan view of the drainage structure cleaning tool of FIG. 13*a*.

FIGS. 13*a* and 13*b* are two views of an embodiment of another drainage structure cleaning tool 1300. The cleaning tool 1300 comprises a "push bucket" 1302 with an overall substantially cylindrical shape. The push bucket 1302 comprises a proximal closed end 1304 and a distal open end 1306. The distal open end 1306 is integrally connected to a side opening 1308 of the push bucket 1302. The proximal opening 1306 is contoured to have a digging lip 1310. The digging lip 1310 has an advanced edge ahead of the rest of the push bucket that facilitates digging under or into compacted soil and debris along the sides of the drainage structure. A plurality of catches 1312 are disposed along the digging lip 1310 on the inside wall of the push bucket 1302.

The push bucket 1302 is coupled to or mounted onto a drill rod 1320. The drill rod 1320 defines an inner longitudinal fluid-conducting channel 1322 that is in fluid-communication with a plurality of nozzles 1324 disposed at the distal end of the drill rod 1320 inside and/or outside the push bucket 1302. Preferably, the drill rod 1320 is accommodated in an opening 1328 in the proximal closed end 1304 of the push bucket 1302 and is welded or otherwise securely attached to the push bucket 1302. The site of the opening 1328 is preferably near the bottom of the bucket away from the side opening of the bucket. Two support flanges 1326 further affix the drill rod 1320 to the closed proximal end 1304 of the push bucket 1302. Preferably the distal end of the drill rod 1320 terminates well before reaching the digging lip 1310 of the push bucket. Therefore, nearly the entire volume of the push bucket is available to load and convey dislodged and loosened debris from the drainage structure. The proximal end of the drill rod 1320 may comprise a coupler 1330 such as a splined connector operable to be connected to one or more extension rods.

In operation, the push bucket tool 1300 may be used when the distal end of the drainage structure has been selected as the exit site of the debris. Generally, after a tool of the type shown in FIGS. 1*a*-2*b* and 11*a*-11*c* has been used to loosen the debris compacted and lodged in the drainage structure, the push bucket tool 1300 may be subsequently used to move and evacuate the dislodged debris toward the distal end of the drainage structure. The digging lip 1310 of the push bucket 1302 enables a substantial amount of the debris to be loaded and transported out of the drainage structure. Furthermore, the push bucket tool 1300 may be advantageously used to dig into the side walls of the drainage structure to further loosen the debris therein. The push bucket tool 1300 may be pushed to dig, using the digging lip, load the bucket, and then rotated to unload the debris collected therein, then pushed to dig and load the bucket, then rotated to unload the debris, and so on. Once most of the debris inside a segment of the drainage structure has been loosened, the push bucket can be used to load and push the dislodged debris out of the drainage structure.

Although the pull bucket tool 1200 and the pull bucket tool 1300 described above are shown as having substantially cylindrical cross-sections, these tools may utilize buckets of other shapes appropriate for cleaning the drainage structure at hand. For example, a cubic-shaped bucket may be used to clean a square or rectangular-cross-sectioned drainage structure.

Any machinery that is operable to controllably rotate and advance the drainage cleaning tools may be used such as a horizontal directional drill manufactured by Vermeer Manufacturing Company of Pella, Iowa. Further, a sonde may be used to enable the detection and steering of the cleaning tools in the drainage structure. In addition, sonde may also be used to determine the angular orientation of the cleaning tool so that the cleaning tools such as the push and pull buckets may be manipulated to scoop and dump the debris.

Figure 14:
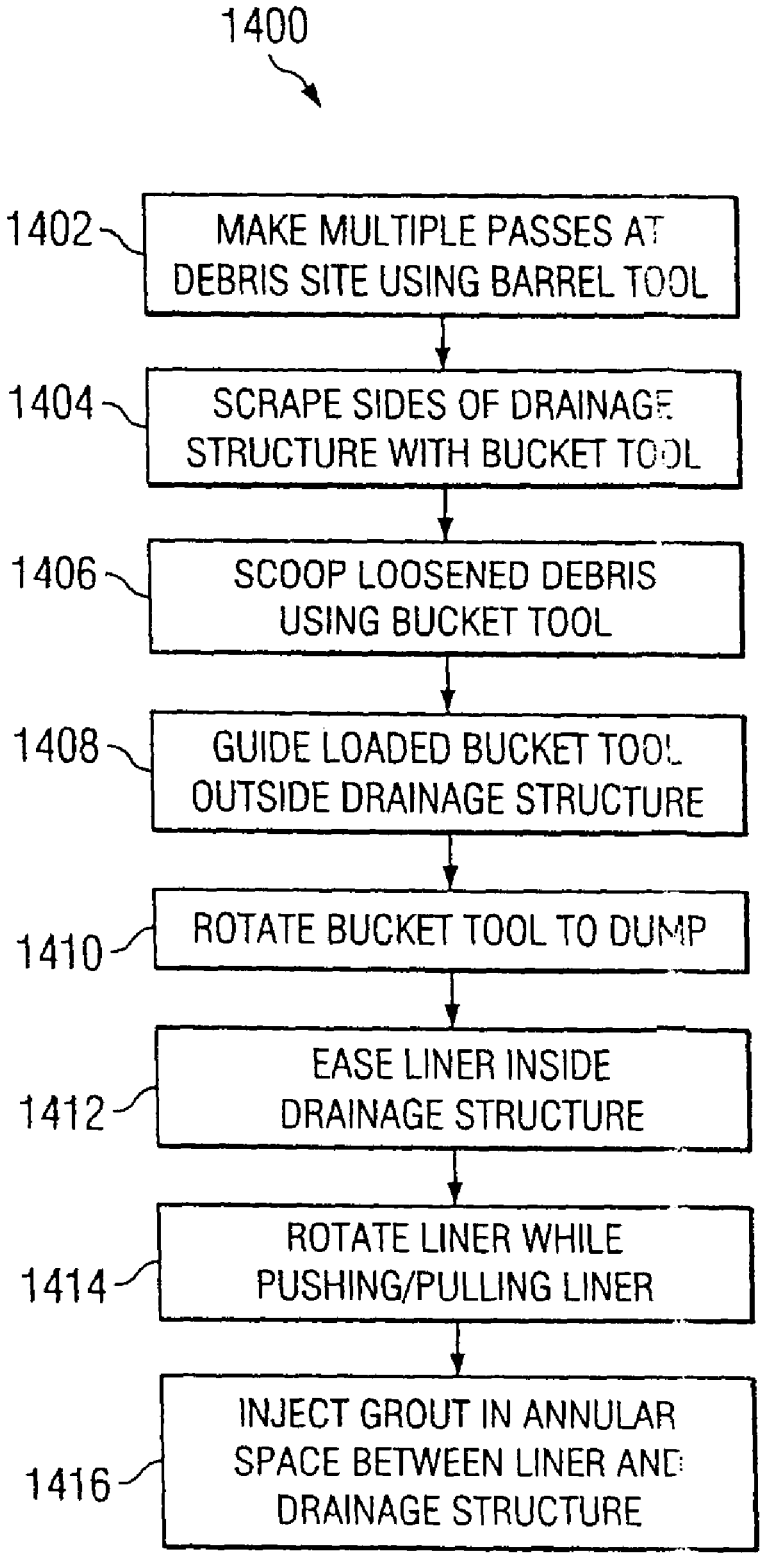
FIG. 14 is a flowchart illustrating a method for cleaning and post-clean preparation of a drainage structure.

FIG. 14 is a flowchart illustrating a method 1400 for cleaning and post-clean preparation of a drainage structure step 1402, a cleaning tool such as the tool 1100 described above is first used to make multiple passes through the drainage structure to tear through compacted debris. Pressurized fluids may be used to further assist in loosening the debris lodged in the drainage structure. In step 1404, the push or pull bucket tools are used to scrape and otherwise remove debris from the sides of the drainage structure. In steps 1406 and 1408, the bucket tool is used to scoop and otherwise load the dislodged debris into the bucket and then guided out of the drainage structure to dump the load outside the drainage structure in step 1410. The bucket tool is steered and rotated to direct the digging lip of the bucket tool along the sides of the drainage structure to scrape off the compacted debris and then to rotate the bucket tool so that the debris load can be emptied from the bucket. Steps 1406-1410 may be performed multiple times to thoroughly clean the drainage structure.

After the drainage structure is thoroughly cleaned, a liner may be positioned in place. In steps 1412 and 1414, the liner is eased into place inside the drainage structure by pulling and/or pushing the liner while rotating the liner to help guiding the liner in place. In step 1416, grout is then injected into the annular space between the liner and drainage structure.

The foregoing has outlined features of several embodiments according to aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A tool for cleaning a drainage structure, comprising:

a rod having a center longitudinal axis and a fluid-conducting channel in fluid-communication with at least one nozzle opening disposed about the rod;

a barrel housing having a cylindrical inside and outside profile compatible with a cross-sectional shape of a drainage structure and having a proximal opening and a distal opening, the barrel housing having a center longitudinal axis and coupled coaxially to the rod, the barrel housing having an outside dimension that can be accommodated within a drainage structure;

a plurality of cutting implements disposed inside the barrel housing radially coupled to and spanning the rod and a cylindrical internal surface of the barrel housing so that the rod is secured to the inside profile of the barrel housing by the cutting implements, each of the cutting implements having a distal cutting edge which extends in a lengthwise direction of the cutting implement and a forwardly facing sweeping face that is angularly oriented to facilitate sweeping debris in a selected direction, each of the cutting edges has opposite ends thereof that are spaced from one another in a direction along the center longitudinal axis; and the barrel housing and cutting implements are operable to rotate about the center longitudinal axis of the rod to dislodge and loosen debris inside the drainage structure.

2. The tool of claim 1, wherein the forwardly facing sweeping face extends rearwardly from the cutting edge at a sweeping angle.

3. The tool of claim 1, wherein the distal opening of the barrel housing has a sinusoidal tearing contour.

4. The tool, as set forth in claim 1, wherein the plurality of cutting implements are equiangularly spaced from each other with the sweeping faces of each implement facing in a common direction.

5. The tool as set forth in claim 1, further comprising a plurality of spaced, outwardly facing cutting teeth in a linear series along the cutting edge of each cutting implement.

6. The tool as set forth in claim 1, wherein each of the plurality of cutting implements taper in width in a radially inward direction.

7. The tool as set forth in claim 1, wherein the rod further comprises a coupling at its proximal end operable to releasably couple to at least one extension rod coupled to a directional drilling machine.

8. The tool of claim 1 wherein the cutting implements are mounted onto the rod at an angle facing in the sweeping direction from the center longitudinal axis of the rod which is less than 90 degrees.

* * * * *